US006174007B1

(12) United States Patent
Schlack et al.

(10) Patent No.: US 6,174,007 B1
(45) Date of Patent: Jan. 16, 2001

(54) ACTUATOR ASSEMBLY

(75) Inventors: Richard E. Schlack, Rising Sun, MD (US); Richard B. Langkamp, Jr., Hemlock, NY (US); Richard M. Plummer, Kennett Square, PA (US); D. Dale Turner, Honeoye Falls, NY (US)

(73) Assignee: Southco, Inc., Concordville, PA (US)

( * ) Notice: Under 35 U.S.C. 154(b), the term of this patent shall be extended for 0 days.

(21) Appl. No.: 09/313,975

(22) Filed: May 19, 1999

Related U.S. Application Data

(60) Provisional application No. 60/109,713, filed on Nov. 24, 1998, and provisional application No. 60/087,437, filed on Oct. 1, 1998.

(51) Int. Cl.[7] ..... E05B 3/00

(52) U.S. Cl. ..... 292/336.3; 292/DIG. 30; 292/DIG. 31; 70/208

(58) Field of Search ..... 292/336.3, DIG. 30, 292/DIG. 31, DIG. 53, DIG. 52, DIG. 60; 70/208, 210, 215, 461; 74/102, 103, 104

(56) References Cited

U.S. PATENT DOCUMENTS

| | | | | |
|---|---|---|---|---|
| D. 343,782 | | 2/1994 | Gromotka et al. | D8/331 |
| 4,343,501 | * | 8/1982 | Meeks | 292/113 |
| 4,693,503 | | 9/1987 | Bisbing | 292/210 |
| 4,880,261 | * | 11/1989 | Bisbing | 292/DIG. 31 |
| 5,064,228 | * | 11/1991 | Bisbing | 92/DIG. 31 |
| 5,201,557 | | 4/1993 | Schlack | 292/161 |
| 5,267,762 | | 12/1993 | Gromotka | 292/229 |
| 5,375,894 | | 12/1994 | Schlack | 292/36 |
| 5,409,272 | | 4/1995 | McCormack | 292/66 |
| 5,556,145 | * | 9/1996 | Takasaki | 292/DIG. 31 |
| 5,609,373 | | 3/1997 | Gromotka | 292/229 |
| 5,722,269 | | 3/1998 | Simon et al. | 70/208 |
| 5,829,802 | * | 11/1998 | Anderson et al. | 292/336.3 |
| 5,975,597 | * | 11/1999 | Makiuchi et al. | 292/336.3 |

OTHER PUBLICATIONS

Southco Latches and Access Hardware Handbook 48, North American Edition (Southco Inc., Pennsylvania 1998), Compression Latches, pp. E–21 to E–24.

* cited by examiner

*Primary Examiner*—Lynne H. Browne
*Assistant Examiner*—John B. Walsh
(74) *Attorney, Agent, or Firm*—Paul & Paul

(57) ABSTRACT

An actuator is used for operating a variety of latching mechanisms. In one embodiment, the latching mechanism includes a rotatable connecting member comprised of a single piece or of separate pieces attached together and the actuator includes a handle assembly operable through pivotal movements of a handle. In operation, the actuator is mountable in a panel or similar member so that the pivoting motion of the handle occurs along a longitudinal axis of the connecting member.

47 Claims, 26 Drawing Sheets

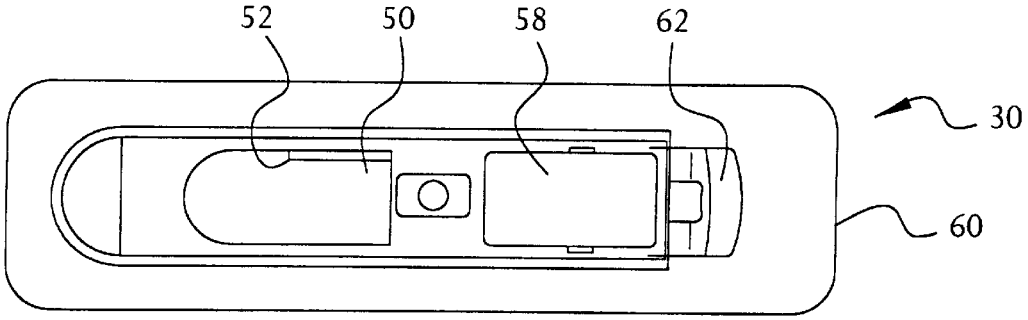
FIG. 9
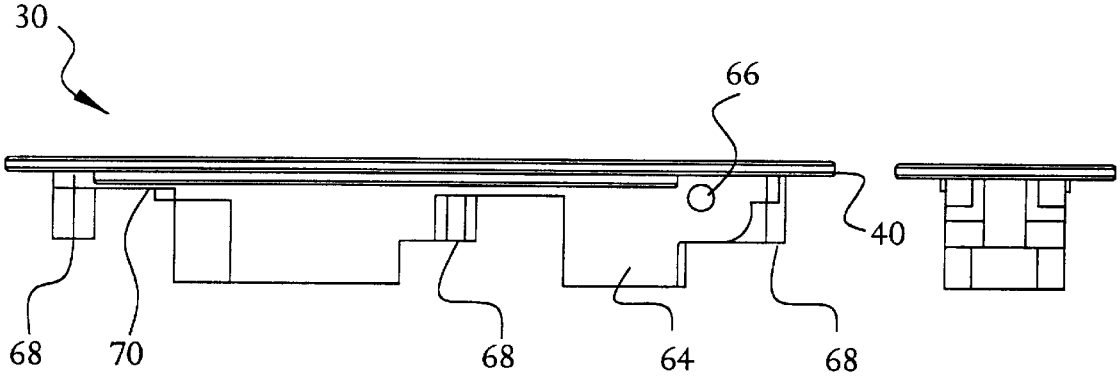
FIG. 11
FIG. 10
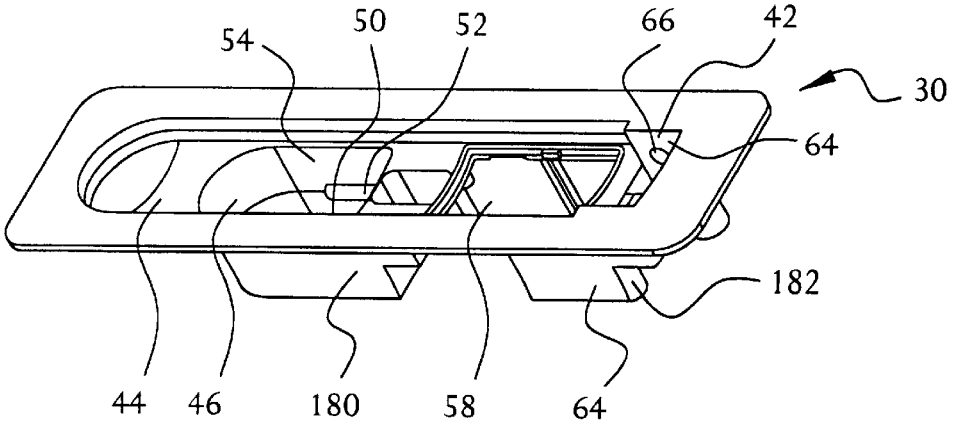
FIG. 12

ACTUATOR ASSEMBLY

CROSS-REFERENCE TO RELATED APPLICATIONS

This application is based on U.S. Provisional Patent Applications No. 60/087,437 filed Jun. 1, 1998 and No. 60/109,713 filed Nov. 24, 1998.

BACKGROUND OF THE INVENTION

1. Field of the Invention

The present invention relates generally to the field of latching mechanisms, and particularly to the field of remote latching mechanisms.

2. Brief Description of Prior Art

Many types of remote latching mechanisms are known and used in the art. A remote latching mechanism, as the term is used herein, is a latching mechanism in which the latching action of the mechanism occurs at a location remote from the latch actuator part of the mechanism.

SUMMARY OF THE INVENTION

The present invention is directed towards actuator devices for use in latching mechanisms; for example, a remote latching mechanism.

BRIEF DESCRIPTION OF THE DRAWINGS

FIG. 9 is a top plan view of a housing in accordance with the handle assembly of FIG. 1.

FIG. 10 is a front elevational view of the housing in FIG. 9.

FIG. 11 is a right side elevational view of the housing in FIG. 9, the left side being a mirror image.

FIG. 12 is a perspective view of the housing in FIG. 9.

DETAILED DESCRIPTION OF THE PREFERRED EMBODIMENTS

Figure 1:
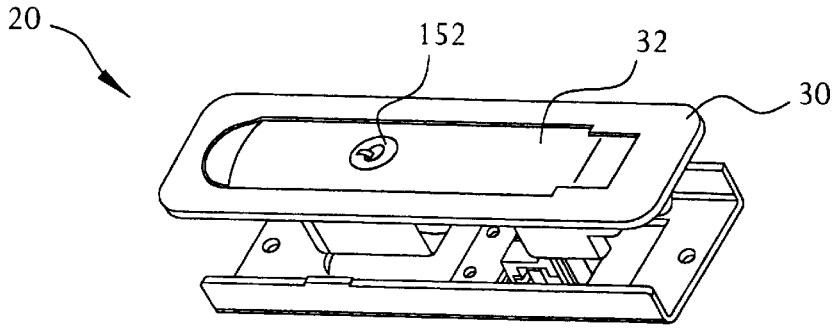
FIG. 1 is a perspective view of a handle assembly in accordance with an embodiment of the present invention.

With reference to the drawings in detail, wherein like reference numerals indicate like elements throughout the several views, an actuator in accordance with the present invention is disclosed herein. The actuator of the present invention can be used in the operation of a variety of different types of latching mechanisms, and in the drawing figures are illustrated one embodiment of the actuator of the present invention adapted for use in a remote latching mechanism. In the present embodiment, the actuator is incorporated within a remote latching mechanism of the type disclosed in U.S. Pat. Nos. 4,880,261 ('261 Patent) and 5,064,228 ('228 Patent), each to Robert H. Bisbing and assigned to Southco, Inc., assignee of the present invention. The complete disclosures of each of these patents are incorporated by reference herein. In the present invention, the remote latch mechanism comprises an actuator, a connecting means attached to the actuator and at least one latch assembly attached with the connecting means. In the present embodiment, the connecting means is in the form of at least one continuous bar or rod and with each latch assembly incorporated in the remote latching mechanism being mounted to the bar or rod. The structure and operation of the connecting means and each latch assembly of the present embodiment is identical to that disclosed in the '261 and '228 patents, and for the sake of brevity, those particular features will not be described herein and reference is made to the '261 and '228 patents for a complete description of these features. For ease of reference, a copy of the '261 patent is attached hereto as Exhibit A.

The handle assembly 20 of the present embodiment includes, as portions thereof, a housing 30, a handle 32 and a slide assembly, which in this embodiment comprises a slide 34, a cage 36 and a crank 38, the details of which will be described in detail below.

The housing 30 is a generally elongated member defined by a flange 40 and a cavity 42 extending within an upper surface of the flange 40 and terminating by an inner cavity surface 44. In addition, the housing 30 in this embodiment includes within the inner cavity surface 44 an aperture 46 generally rectangular shaped and having one radiused end positioned proximate a rear end 48 and terminating by a bottom surface 50. In addition, in this embodiment, preferably a keeper is positioned within the aperture 46, which in the present embodiment comprises a boss 52 generally rectangular in configuration attached to a side surface 54 defined by the aperture 46 and generally perpendicular the bottom surface 50. In the present embodiment, a cavity 56 generally square shaped in this embodiment is provided within the bottom surface 50. The housing 30 in this embodiment also includes an aperture 58 extending within the inner cavity surface 44 and positioned proximate a front end 60. In the present embodiment, preferably the aperture 58 in this embodiment is generally rectangular in configuration and preferably extends through the housing 30. The housing 30 also includes a cavity 62 positioned adjacent to the aperture 58 and between the aperture 58 and front end 60. In this embodiment, the cavity 62 is generally square shaped in configuration defined by a pair of generally opposing side walls 64 with an opening 66 generally circular in configuration in this embodiment extending through each of the side walls 64. Further, as will be described herein, means for mounting of the housing 30 is also provided and in the present embodiment for this purpose at least one and preferably four threaded openings 68 or holes for a conventional self-tapping screw are provided within the lower outer surface 70 of the housing 30.

The handle 32 is generally elongated in configuration and in this embodiment includes a perimeter surface corresponding in configuration to the configuration of the cavity 42 extending within the upper surface of the flange 40 of the housing 30. For example, in this embodiment, the handle 32 is defined by a first portion 72 generally square shaped in configuration positioned adjacent to a front end 74 and a second portion 76 generally elongated along a longitudinal axis and having a diameter transverse the longitudinal axis larger than a diameter of the first portion 72. The second portion 76 at its end distal the first portion 72 is generally radiused in configuration adjacent to the rear end 78 of the handle 32. In addition, in this embodiment, the handle 32 includes a bottom surface 79 having extending therefrom a platform 78 which in this embodiment is generally boxed shaped in configuration. In addition, preferably the handle 32 includes a cavity 80 which is generally cylindrical in configuration extending within an upper surface 82 and terminating within the platform 78. In addition, in this embodiment, preferably the platform 78 includes an opening 84 positioned within one of four side surfaces of the platform 78 positioned substantially perpendicular to the bottom surface 79. In addition, in the present embodiment, a projection 86 generally triangular in shape is provided extending from the bottom surface 79 proximate the front end 74. In the present embodiment, preferably the projection 86 terminated by a generally T-shaped portion 88. In addition, in this embodiment, the handle 32 includes a pair of elongated channels 90 provided within the bottom surface 79 extending in a longitudinal direction of the handle 32 and positioned adjacent opposite sides of the platform 78.

The handle 32 in this embodiment also includes means for retaining the handle 32 in a closed position relative to the housing 30 comprising in this embodiment a lock pawl 92. The lock pawl 92 is generally square shaped in configuration comprising a semi-circular shaped cut out 94 generally extending through the center, a generally square-shaped cut out 96 adjacent to a first end 98, a generally cylindrical boss 99 extending from the first end 98 positioned within cut out 96 and on a second end 100 distal the first end 98 a ramped camming surface 102 and a locking surface 104. The assembly and operation of the lock pawl 92 will be described in detail below.

The slide 34 in the present embodiment is generally z-shaped in configuration comprising two generally boxed shaped platforms 106 and 108 and a generally rectangular shaped connecting portion 110 connecting the platforms 106 and 108. The platform 106 includes a generally square shaped cavity 112 within an outer surface distal the connecting portion 110 and a generally rectangular shaped cut out 114 extending within a surface 116 and into the cavity 112. The connecting portion 110 includes opposing surfaces 118 and 120 with the platform 106 being attached to the surface 118 and the platform 108 being attached to the surface 120. The platform 108 is attached proximate a second end of the connecting portion 110 distal the platform 106, which is attached proximate a first end of the connecting portion 110. In addition, the connecting portion 110 includes channels 122 within opposing sides and which extend along its longitudinal axis. The platform 108 defines rectangular shaped cavity 124 extending within a side surface 126 and into a cavity 128, which is generally T-shaped in configuration extending through the platform 108 transverse the longitudinal axis of the connecting portion 110.

The cage 36 in the present embodiment is a generally box-like structure having opposing side walls 130, and with each of the side walls 130 having two generally cylindrical shaped bosses 132 substantially aligned with each other and positioned proximate two of four corners defining the side walls 130. In addition, in this embodiment, each of the side walls 130 include a single generally triangular shaped boss 134 positioned proximate a third corner and generally aligned with one of the two bosses 132. The cage 36 in this embodiment also includes a connecting wall 136 adjoining the side walls 130, and with the connecting wall 136 having a generally square shaped cavity therethrough positioned proximate one end thereof and substantially aligned with one end of the side walls 130 positioned adjacent to the bosses 134. The cage 36 also includes in this embodiment a generally rectangular shaped cut out 138 extending through a fourth side wall 140 opposing the connecting wall 136. In addition, the cage 36 in this embodiment includes a generally rectangular shaped cavity extending longitudinally through the cage 36 and extending into the cut out 138 through the fourth side wall 140. The cage 36 in the present embodiment also includes bosses 158 defined by the cut out 138 extending through the fourth side wall 140.

The crank 38 in this embodiment is a generally L-shaped member having a generally cylindrical shaped connecting member 142 positioned at one end thereof and including an opening 144 extending longitudinally through the member 142 which is generally hexagonal shaped in this embodiment, although as should be understood other configurations can also be utilized for the same purpose described below. The crank 38 also includes a second end distal the member 142, which is generally T-shaped in configuration defined by a pair of opposing bosses 146 each generally cylindrical in configuration. In addition, in this embodiment, the crank 38 also includes a connecting section 148 attaching the first and second ends thereof and which includes opposing side walls each having a generally C-shaped cavity extending therein.

The foregoing components of the handle assembly 20 can be comprised of any suitable materials and made from any of a variety of manufacturing processes; for example, the housing 30, handle 32, slide 34, and crank 38 can be made from die cast zinc and the cage 36 and lock pawl 92 can be made from polycarbonate. In addition, each of the foregoing components can each be made as single elements or as separate elements and then secured together; for example, the housing 30 can be cast as one-piece or the bottom surface 50 can be provided as a separate element secured with the housing 30 adjacent to the aperture 46 by any suitable process, such as by peening over one or more portions of the housing 30 around the separate bottom surface 50, and where desired, including a suitable amount of sealant material, such as silicon.

The assembly of the foregoing components of the handle assembly 20 will now be described in relation to the exploded perspective and sectional views. Lock pawl 92 is attached to the handle 32 by being inserted into the opening 84 provided through the platform 78. In addition, means for actuating the lock pawl 92 is preferably also provided positioned within the cavity 80 extending within the upper surface 82 of the handle 32 and extending into the semi-circular shaped cut out 94 of the lock pawl 92. In this embodiment, any of a variety of different means for actuating the lock pawl 92 can be provided, such as a conventional lock or other type of lock plug, such as a DIN lock plug, and which is actuated by a key or other tool, an electronics key, or a non-keyed type of rotatable actuator or push botton, to name a few. In addition, as should be understood, the size and configuration of the cavity 80 extending through the handle 32 and shape of the cut out 94 within the lock pawl 92 can be varied where desired depending on the particular configuration of the means for actuating the lock pawl 92. In the illustrated embodiment, a conventional lock plug 152 is positioned within the circular cavity 80 of the handle 32 and into the semi-circular shaped cut out 94 through lock pawl 92. In addition, in this embodiment, a spring 154, such as a conventional stainless steel compression spring, preferably is included positioned within the cut out 96 and against the boss 94 of the lock pawl 92 and surface of the handle 32 for biasing the lock pawl 92 to an extended position.

The handle 32 is attached to the housing 30 in this embodiment by a conventional pivot pin 156, such as made from stainless steel, and which extends through the opposing cavities within the side walls of the housing 30 and openings within the handle 32 positioned proximate the front end 74. The pivot pin 156 can also be peened over at its end for being retained in its mounted position. In addition, the handle 32 is attached to the slide 34 by being positioned within the slide cavity 112 and cut out 114 of the platform 106.

The slide 34 is received within the cage 36 and with preferably the two elongated bosses 158 defined by the fourth side wall 140 being positioned within the opposing channels 122 provided in the opposing sides the slide 34. In this embodiment, the position of the cage 36 relative to the slide 34 is such that the platform 106 of the slide 34 is positioned closer to the generally rectangular shaped cavity extending longitudinally through the cage 36 than is the platform 108.

The cage 36 is positioned within the generally rectangular shaped cavity extending through the housing 30. Preferably, the connecting wall 136 of the cage 36 is positioned closest to the front end 60 of the housing 30 and preferably the cutout 138 within the connecting wall 136 is positioned closer to the flange 40 of the housing 30 than are the bosses 132. In this embodiment, preferably the housing 30 is provided with four cut out portions 160 positioned so as to receive the four bosses 132 provided on the side walls 130 of the cage 36.

The crank 38 is attached to the slide 34 by the two bosses 146, which are positioned within the cavity 128 within the platform 108 of the slide 34. As indicated above, the handle assembly 20 of the present embodiment for operation in a remote latching mechanism is attached to a connecting means, such as a bar or rod, extending within the opening 144 within the member 142 of the crank 38.

In addition, a biasing means such as a leaf spring 171 of stainless steel can also be included on the handle 32 as illustrated in the figures to accommodate movement of the handle 32 toward its open positioned after being unlatched, as will be described in detail below.

Installation and operation of the handle assembly 20 of the present embodiment will now be described. As discussed earlier, the actuator in acccordance with the present invention can be utilized with a variety of different types of latching mechanisms. In the present embodiment, the handle assembly 20 is specifically adapted for use with a remote latching mechanism, such as the type illustrated in the '261 and '228 Patents, although as should be understood the handle assembly 20 can also be utilized with other types of remote latching mechanisms as well, such as any types which include a rotating rod or bar; for example, the type incorporating a fixed latching member rotatable with rotation of the bar or rod. For installation, preferably an aperture is provided through a structure into which the handle assembly 20 is to be mounted, which in this embodiment provides the housing positioned within the aperture and the flange of the housing 30 positioned against one surface of the structure. In the '261 and '228 Patents, the structure into which the remote latching mechanism is mounted is a typical cabinet structure having a door to which the handle assembly is mounted and stationery frame, otherwise it should be understood that there are other types of applications in which the handle assembly of the present invention and corresponding remote latching mechanism can be used.

In addition, in the present embodiment, preferably means are included for securing the handle assembly 20 in its mounted position within the respective structure. For this purpose, a bracket 170 is provided comprising a generally elongated member substantially rectangular in configuration defined by two opposing side walls 172 and a connecting wall 174. In this embodiment, the connecting wall is provided with a pair of aligned apertures 176 and 178, which in this embodiment are configured to correspond to the shape of portions 180 and 182 of the housing 130. In this embodiment, the bracket 170 is preferably made of low carbon steel, although any other suitable materials can also be utilized for the same purpose. On installation, the bracket 170 is positioned so that the portions 180 and 182 of the housing 30 are received wihtin the apertures 176 and 178. The distal ends of the two side walls 172 of the bracket 170 are preferably positioned against a surface of the structure opposite that to which the flange of the housing 30 is positioned. As discussed earlier, mounting means are provided which comprises at least one and in this embodiment four threaded apertures or holes for self-tapping screws within the housing 30, corresponding apertures extending through the connecting wall 174 of the bracket 170 and conventional screw members extending through the apertures through the bracket 170 and into the threaded apertures through the housing 30.

The operation of the handle assembly 20 when secured within a given structure and for actuation of a remote latching mechanism will now be described. Generally, pivotal movement of the handle will correspond with rotation of the connecting means of the remote latching mechanism. In the present embodiment, the handle 32 is pivotal between a closed position recessed within the housing 30 and an open position. The extent of pivotal movement of the handle 32 from the closed position can be of any desired amount, and in the present embodiment the handle 32 is positioned generally 90 degrees from its closed position when in its full opened position. The handle 32 is retained in its closed position due to the engagement between the locking pawl 92 and boss 52 in the housing 30. For example, as the handle 32 is moved toward its closed position, the camming surface 102 of the lock pawl 92 will initially engage the boss 52 of the housing 30, forcing the lock pawl 92 toward its retracted position in opposition to the compression spring 154. When the handle 32 is in its closed position, the lock pawl 92 will move back toward its extended position so that the locking surface 104 will be positioned against the boss 52 of the housing 30. In this embodiment, the upper surface 82 of the handle 32 is preferably positioned substantially flush with the outer surface of the flange 40 when the handle 32 is in its closed position.

In this embodiment, the handle 32 can be raised from its closed position through rotation of the lock plug 152 by an appropriate key. Rotation of the lock plug 152 will result with movement of the lock pawl 92 toward its retracted position due to rotation of the lock plug wihtin the semicircular shaped cut out 94 within the lock pawl 92. In the present embodiment, the spring provided on the handle 32 will move the handle 32 toward its opened position so that the handle 32 can easily be grasped by an operator. Movement of the handle 32 toward its opened position by the operator will result with corresponding rotation of the connecting means and operation of the latching member attached with the connecting means, which will be described in detail below. In this embodiment, partial rotation of the handle 32 from its closed position will result with little and preferably no movement of the slide 34/crank 38 combination and accordingly no rotation of the connecting means. Preferably, in this embodiment this operation occurs to a position of the handle 32 approximately 10 degrees from its closed position, which is the position that the handle 32 is moved into by the spring following unlatching of the lock pawl 92.

In the present embodiment, rotation of the handle 32 by the operator results with sliding movement of the slide 34 within the aperture extending through the housing 30, and which provides corresponding rotation of the crank 38 attached with the slide 34. In this embodiment, the cage 36 is provided so that amount of pivotal improvement of the handle 32 toward its opened position is increased. In particular, as the handle 32 is rotated, the cage 36 is allowed to float within the aperture extending through the housing 30. In operation, the cage 36 generally follows the direction of movement of the slide 34. In addition, as the handle 32 is moved toward its fully opened position, the slide 34 and cage 36 operate in a telescoping manner to allow increased movement of the handle 32 toward its opened position. Further, when the handle 32 is in its fully opened position, in this embodiment the T-shaped portion 88 is positioned within the platform 106 adjacent the cut out 114 and distal the connecting portion 110. In addition, as the handle 32 is moved from its fullest open position toward a partially closed position, the T-shaped portion 88 of the handle is moved in a generally diagonal direction toward the connecting portion 110. The T-shaped portion 88 of the handle 32 in this embodiment engages the connecting portion 110 when the handle 32 is at a specified position, which is generally 60 degrees from the closed position in the present embodiment. In this embodiment, there is little and preferably no movement of the slide 34/crank 38 combination when the handle 32 is moved from its fullest open position to its partially closed position, which is similar to the situation as the handle is moved from its closed to its opened position. In this embodiment, the extent of movement of the handle to its fully opened position corresponds to the amount of rotation translated to the connecting bar or rod.

In addition, means can be provided so that the cage 36 will retain its position within the aperture through the housing 30 and similar means can be provided between the slide 34 and cage 36 so that the position of the slide 34 will be retained within the cage 36. In this embodiment, preferably the bosses 134 of the cage 36 operate to retain the cage 36 within its position within the housing 30 and the raised bosses 190 positioned at the end of the bosses 158 operate to retain the slide 34 by engaging a stop 192 positioned at the end of each of the channels 122. In addition, in the present embodiment, preferably movement of the slide 34 in the opposite direction is limited by wall 194 of slide 34 which contacts wall 196 of cage 36; in particular, the slide 34 is not able to move back without taking cage 36 together with it which resets telescoping mechanism.

Other configurations of the slide 34 can also be provided which are either longer or shorter in length so as to accommodate thicker or thinner structures to which the handle assembly 20 is mounted. For example, in the figures is illustrated a slide 234 of shorter length than slide 34 so as to accommodate thinner structures as an example.

In addition, although not shown, the handle assembly 20 can also include a padlock hasp, for example, attached to the housing and extending through an opening through the handle when the handle is in its closed position, so that a pad lock can be secured to the pad lock hasp to retain the handle in its closed position. The pad lock hasp can be of any suitable material, such as stainless steel.

Another embodiment of a handle assembly in accordance with the present invention is illustrated in FIGS. 75–81. The handle assembly 320 in the present embodiment is similar in both structure and function to many of the features already described in detail with respect to the handle assembly 20, and for this reason, only the differences in the handle assembly 320 from the handle assembly 20 will be described herein for the sake of brevity. Also, for ease of reference, portions in this embodiment similar to the handle assembly 20 will be described using the same number designations except beginning with 300.

Figure 75:
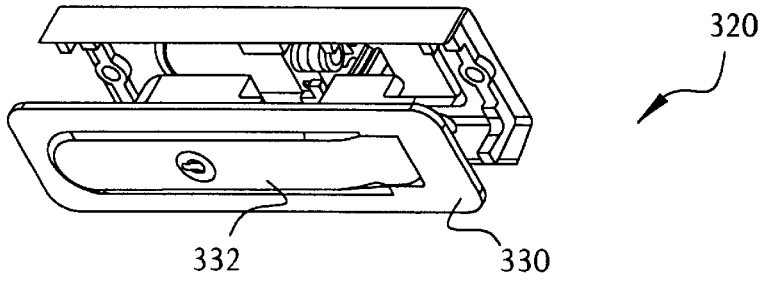
FIGS. 75–81 are views of a handle assembly in accordance with another embodiment of the present invention.
Figure 76:
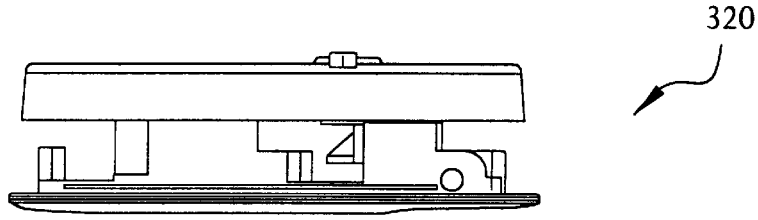
Figure 77:
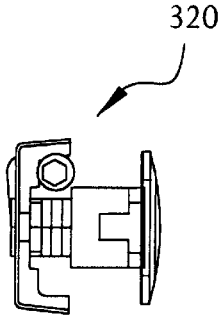
Figure 78:
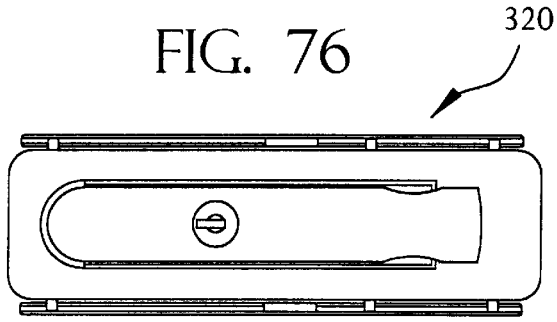
Figure 79:
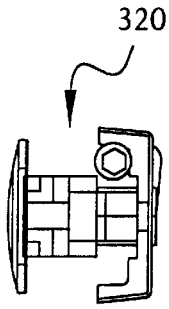
Figure 80:
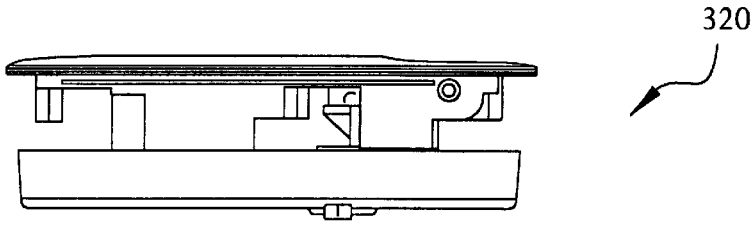
Figure 81:
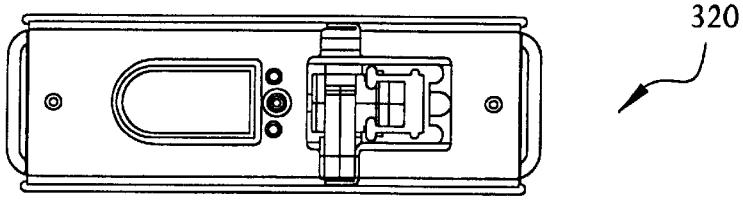
Figure 82:
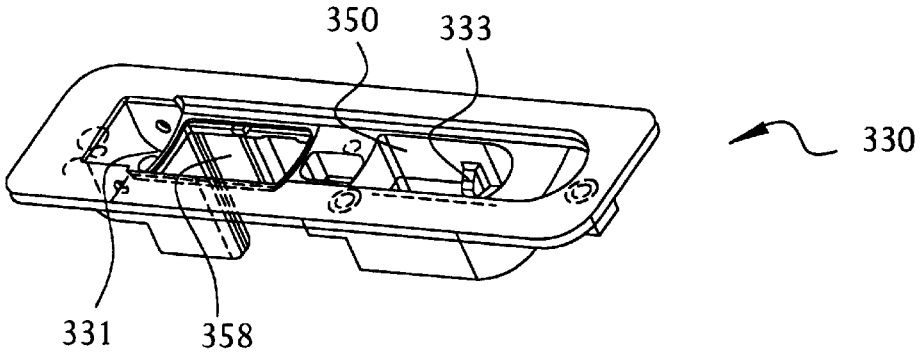
FIGS. 82–84 are views of a housing in accordance with the handle assembly of FIG. 75.
Figure 83:
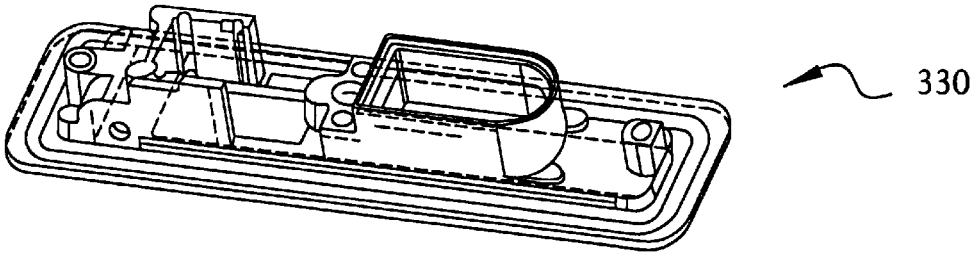
Figure 84:
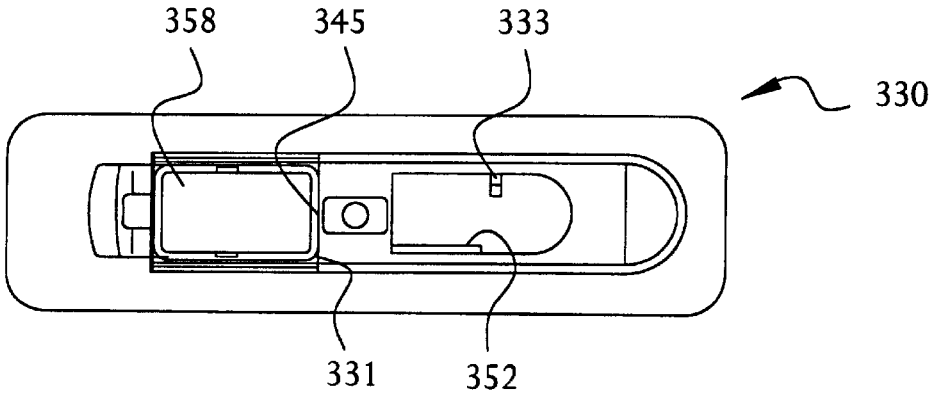
Figure 92:
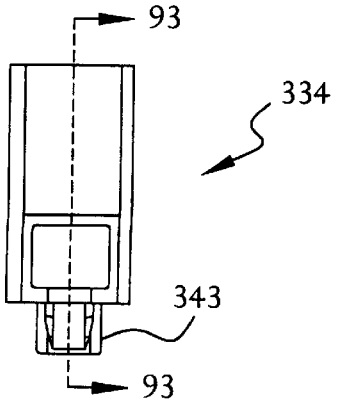

In FIGS. 92–84 is illustrated a housing 330 of the handle assembly 320 shown in FIG. 75. The housing 330 in this embodiment includes a rib 331 around opening 358 to provide a positive sealing edge for gasketing that is applied to the handle 332 described below. In addition, a second tab 333 in this embodiment is added within recess 350 on the wall opposite the tab 352. The tab 333 is included so that the same housing can be used for various configurations of handle, for example, where the lock pawl would be positioned to engage the tab 333 when the handle is moved to the closed position.

Figure 85:
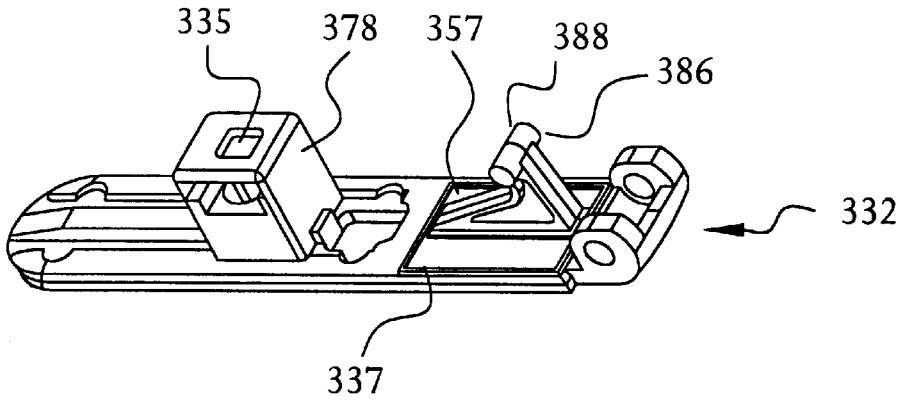
FIG. 85 is a perspective view of a handle in accordance with the handle assembly of FIG. 75.

In FIG. 85 is illustrated a handle 332 of the handle assembly 320 shown in FIG. 75. The handle 332 includes a gasket 337, for example of an elastomeric material, such as made of rubber, which surrounds the projection 386 and is positioned to engage the rib 331 of the housing 330 when the handle is in its closed position. The handle 332 in this embodiment also includes an aperture 335 in the bottom of the platform 378 for receiving a catch portion of the lock pawl described below.

Figure 59:
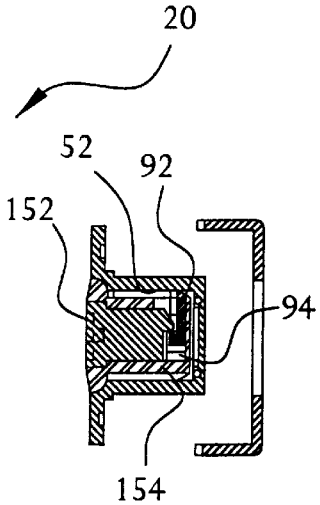
Figure 61:
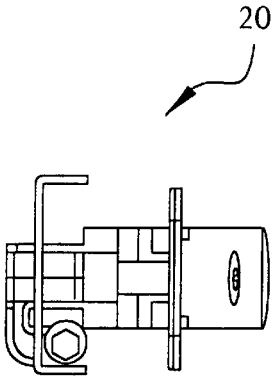
FIGS. 60–62 are views of the handle assembly of FIG. 1 illustrating the handle in a partially open position approximately 10 degrees from a closed position.
Figure 60:
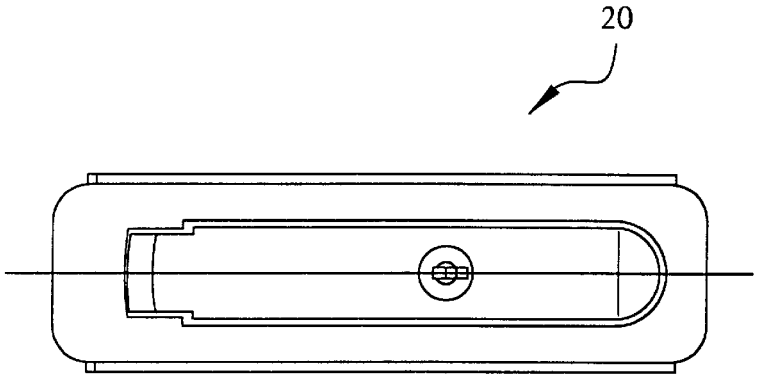

A lock pawl 392 or the handle assembly 320 is shown in FIGS. 87–90. The lock pawl 392 includes a catch 339 extending from its bottom surface, which in this embodiment is generally square in shape and attached at one end to the bottom surface and includes a ramped terminating end. The lock pawl 392 is assembled so that the catch 359 is positioned within the aperture 335 of the handle 332, which operates to positively capture the lock pawl 392 relative to the handle 332. In addition, in this embodiment, the lock pawl 392 also includes at least one and preferably two extensions 341, which are generally rectangular in the embodiment shown. The extensions 391 operate to provide a larger contact area with the driving cam of the lock plug, such as is illustrated in FIG. 59 with the lock plug 152.

Figure 62:
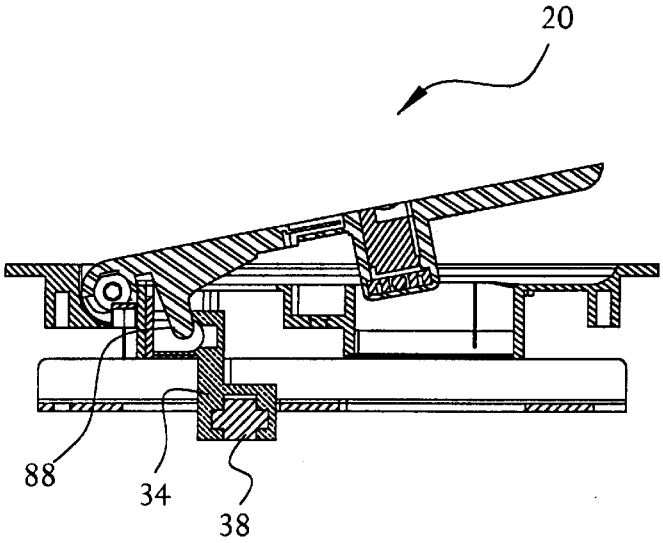
Figure 63:
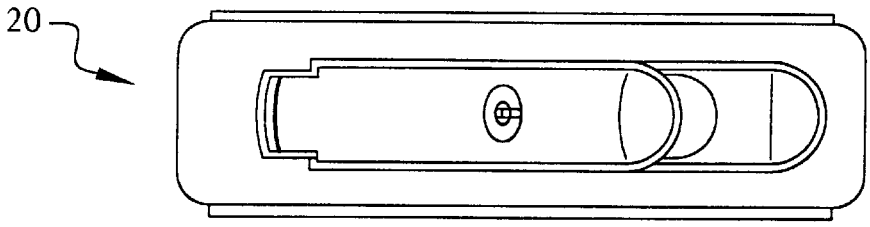
FIGS. 63–65 are views of the handle assembly of FIG. 1 showing the handle in a partially opened position approximately 60 degrees from a closed position.
Figure 65:
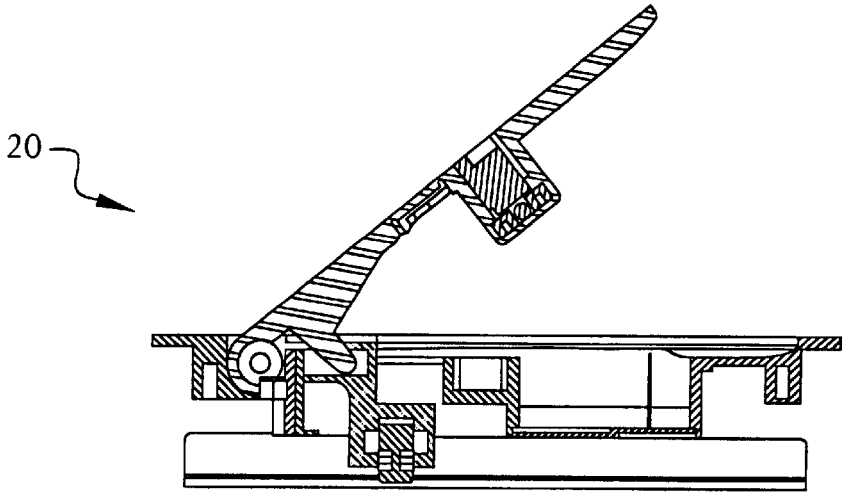
Figure 64:
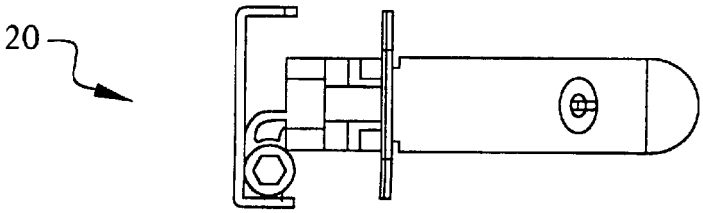
Figure 66:
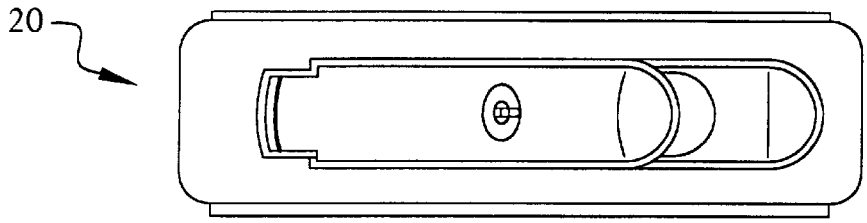
FIGS. 66–68 are the same as the views of FIGS. 63–65 except including a leaf spring on the handle.
Figure 68:
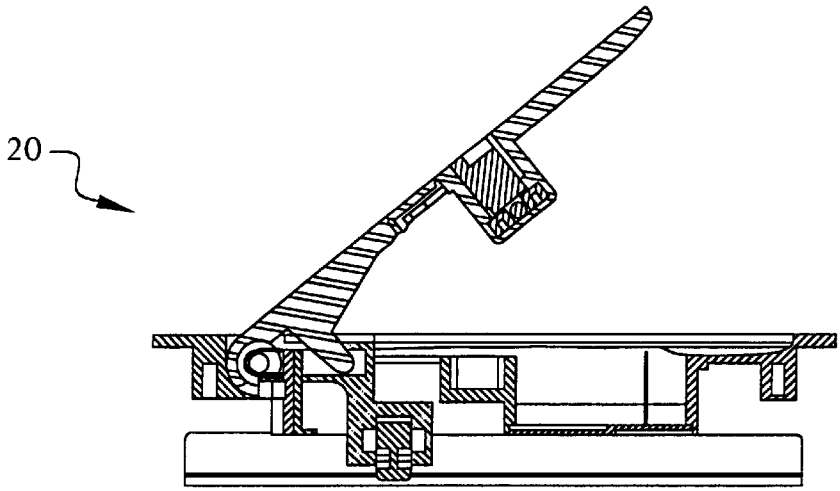
Figure 67:
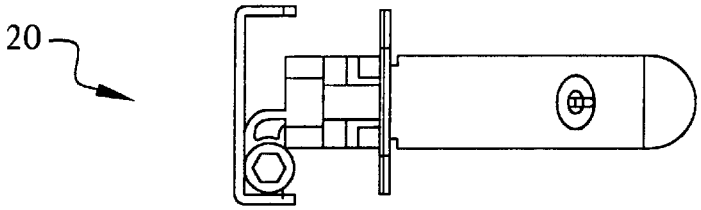
Figure 69:
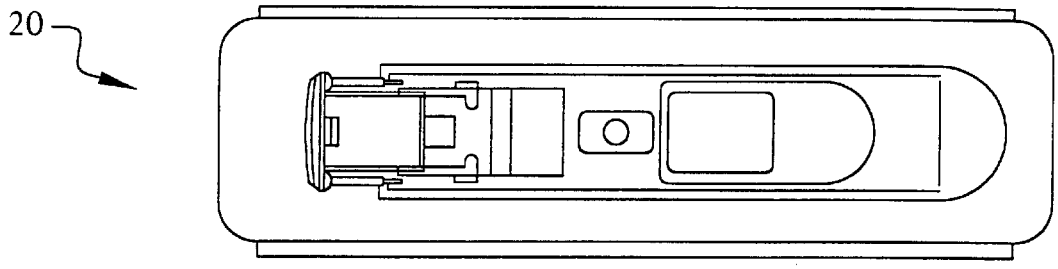
FIG. 69–71 are views of the handle assembly of FIG. 1 showing the handle in a fully open position approximately 90 degrees from a closed position.
Figure 70:
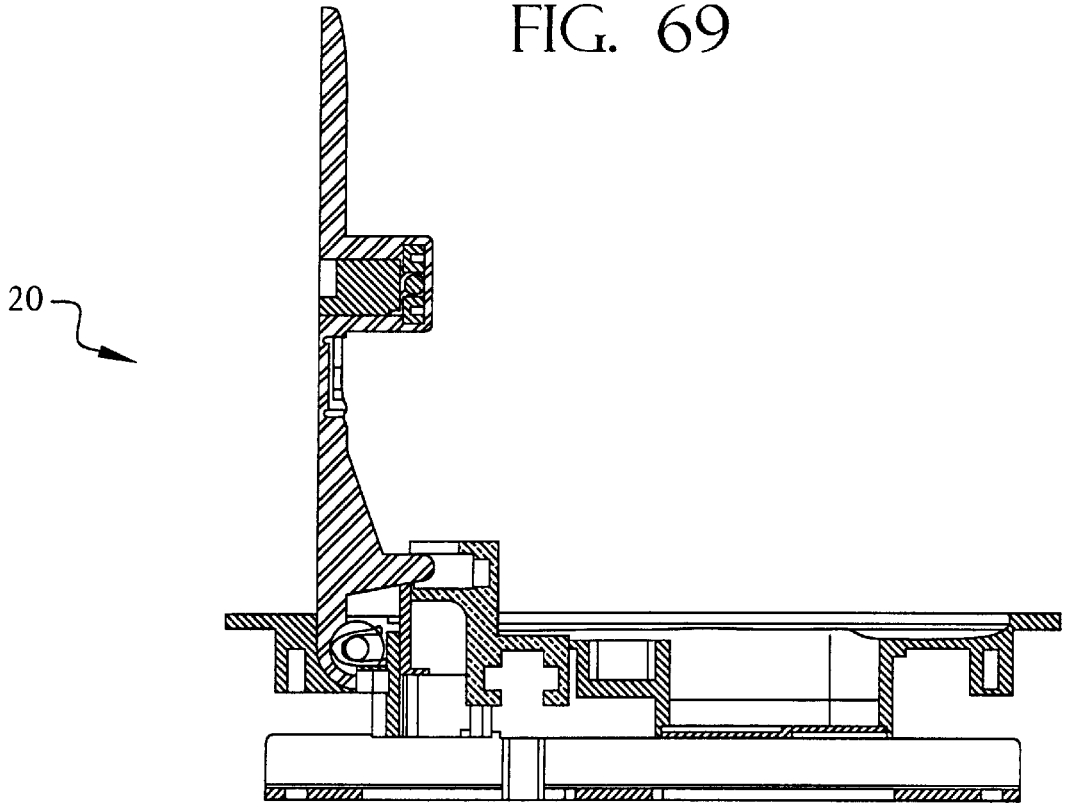
Figure 71:
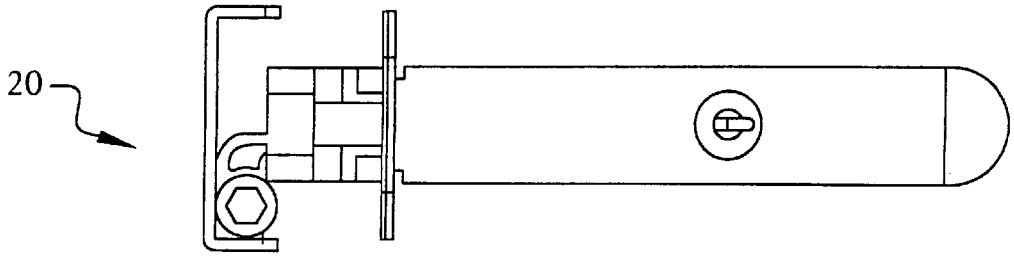
Figure 72:
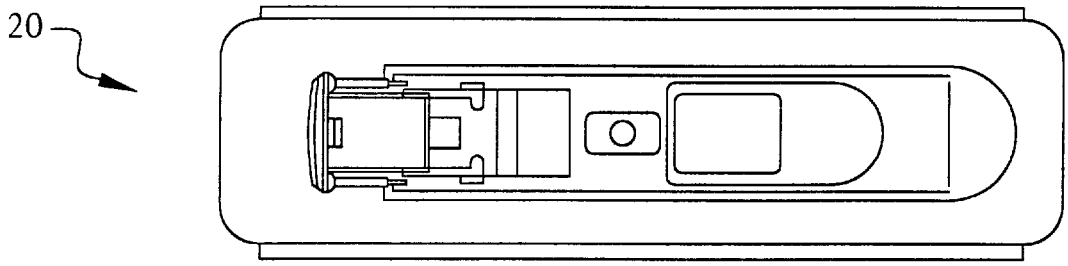
FIGS. 72–74 are the same as the views of FIGS. 68–71 except including a leaf spring on the handle.
Figure 73:
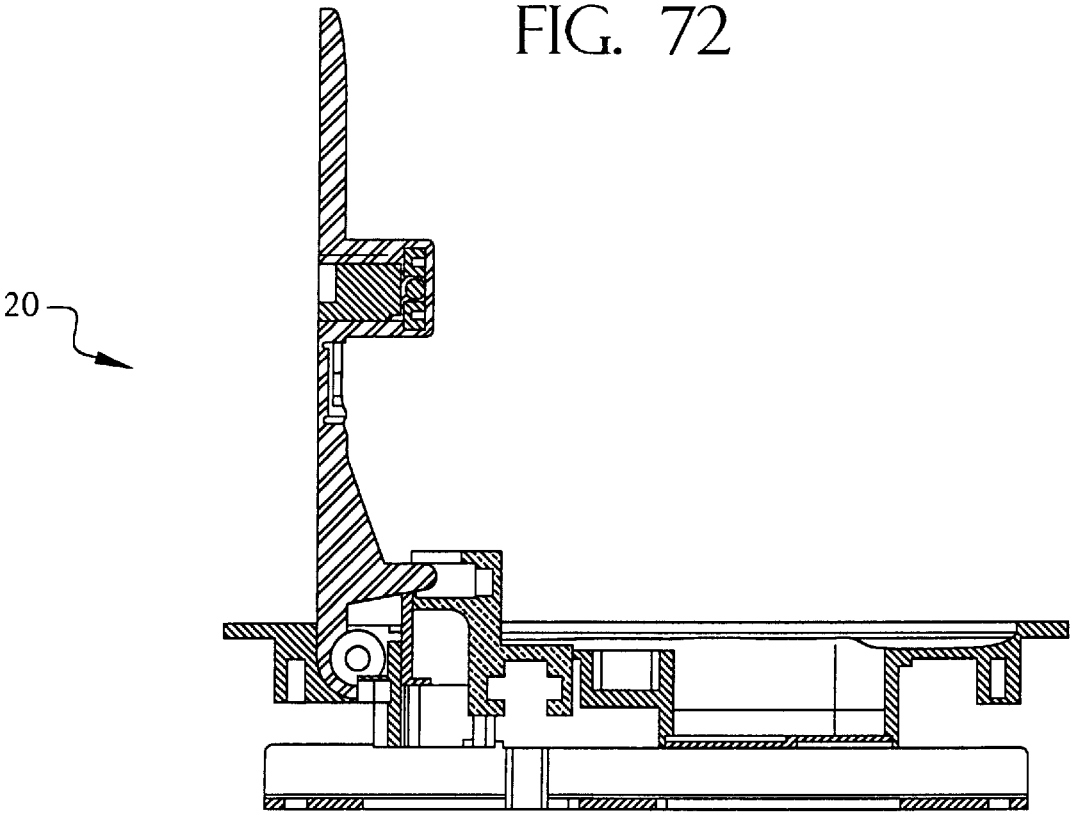
Figure 74:
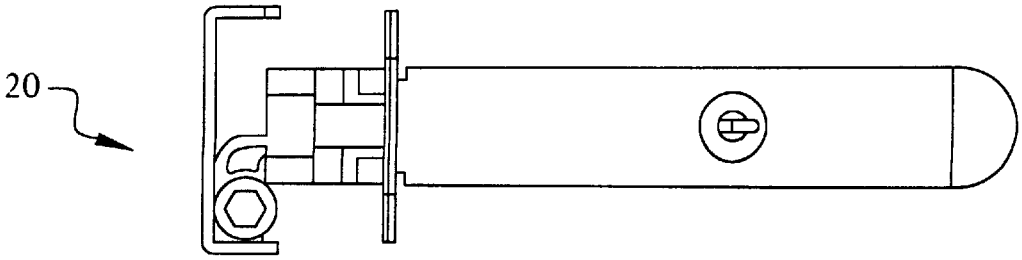
Figure 91:
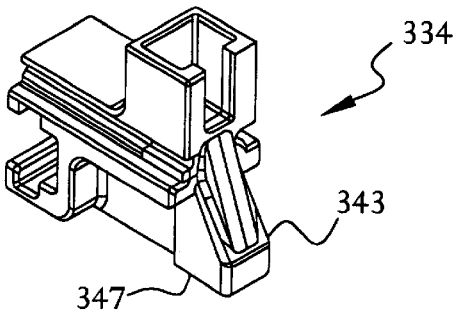
FIGS. 91–93 are views of a slide in accordance with the handle assembly of FIG. 75.
Figure 93:
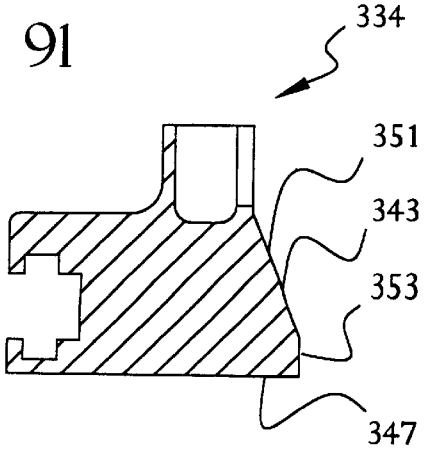

A slide 334 of the handle assembly 320 is shown in FIGS. 91–93. The slide 334 in this embodiment includes an extension 343, generally triangular in shape, extending from the front surface. In operation, the surface 347 of extension 343 is adapted to come into contact with the bottom wall 345 of the housing aperture 358 (as is shown in FIG. 84). This engagement between the extension 343 and the housing 330 inhibits and preferably prevents the slide 334 from tilting when opening force is applied to the handle 332. The tilting is due to the moment created during operation; in particular, the T-shaped portion 388 on the projection 386 of the handle 332 (shown in FIG. 85) does not contact the slide 334 in the same horizontal plane as the contact between the slide 334 and the crank 338, such as is illustrated in FIG. 62 with the projections 88, slide 34 and crank 38. The extension 343 is also used to push the slide 334 into its correct closed position when the handle 332 is fully closed; specifically, this results from contract between one or both of the surfaces 351, 353 of the extension 343 (as shown in FIG. 93) with one or both of the surfaces 355, 357 of projection 386 of the handle 332 (as shown in FIG. 85). This relationship overcomes the same tilting action described above but in the closing direction.

Figure 86:
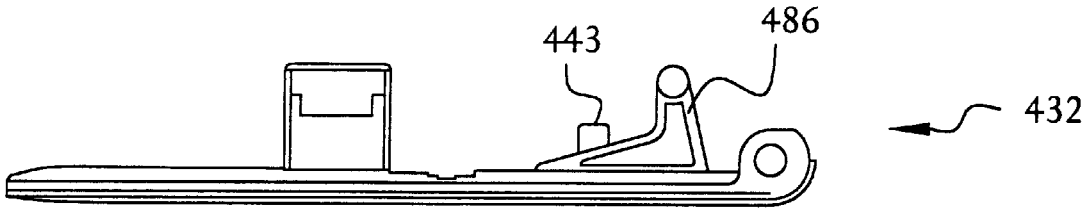
FIG. 86 is a right side elevational view of another embodiment of a handle in accordance with the handle assembly of FIG. 1.
Figure 89:
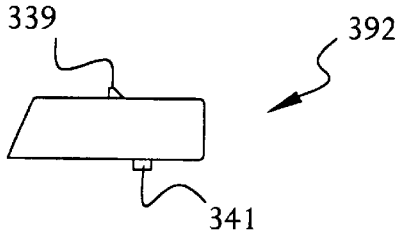
FIGS. 87–90 are views of a pawl lock in accordance with the handle assembly of FIG. 75.
Figure 87:
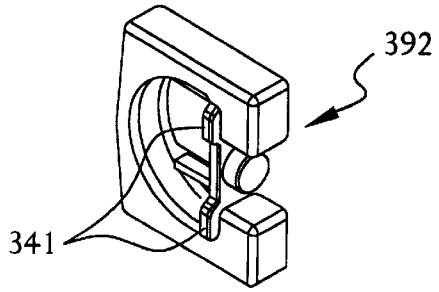
Figure 90:
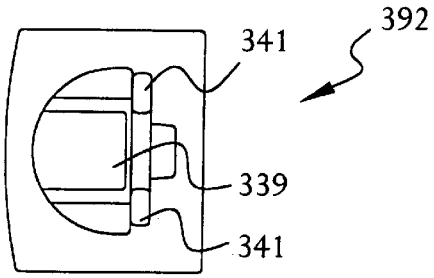
Figure 88:
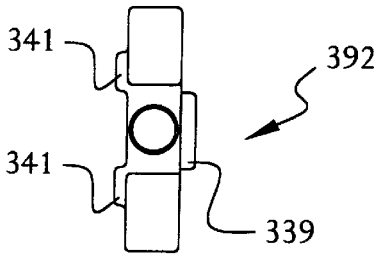

In FIG. 86 is shown an alternate embodiment of a handle 432 in which a protrusion 443 is provided extending from the protection 486. The protrusion 443 operates in combination with the slide 34 to force the slide into its correct position, such as in the same manner as the slide 334 relative to the handle 332.

Figure 94:
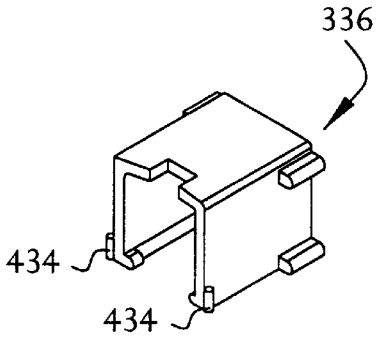
FIG. 94 is a perspective view of a cage in accordance with the handle assembly of FIG. 75.

In FIG. 94 is illustrated a cage 336 of the handle assembly 320. The cage 336 in this embodiment includes two bosses 434 sized larger than the bosses 134 of the cage 36, which operate to increase the strength of these portions.

Figure 95:
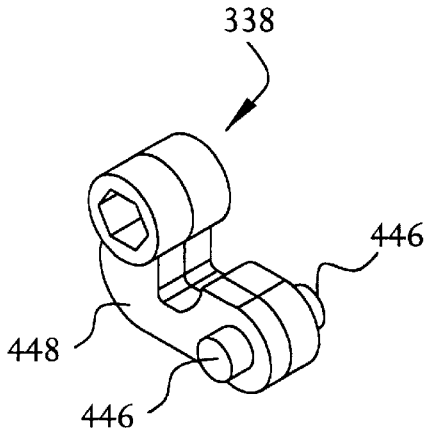
FIG. 95 is a perspective view of a crank in accordance with the handle assembly of FIG. 75.

In FIG. 95 is illustrated a crank 338 of the handle assembly 320. In this embodiment, bosses 446 are preferably created by pressing a pin, such as of stainless steel, into an opening through the crank 338. Also, as compared to the crank 38, the C-shaped cavity has been eliminated in the opposing side walls 448 of the crank 338 in the present embodiment. The crank 338 in the present embodiment preferably is made from either stainless steel, for example, stacked laminates or powder metal, or an aluminum extrusion. These changes operate to increase the maximum bending stress allowed in the part for operation.

Figure 2:
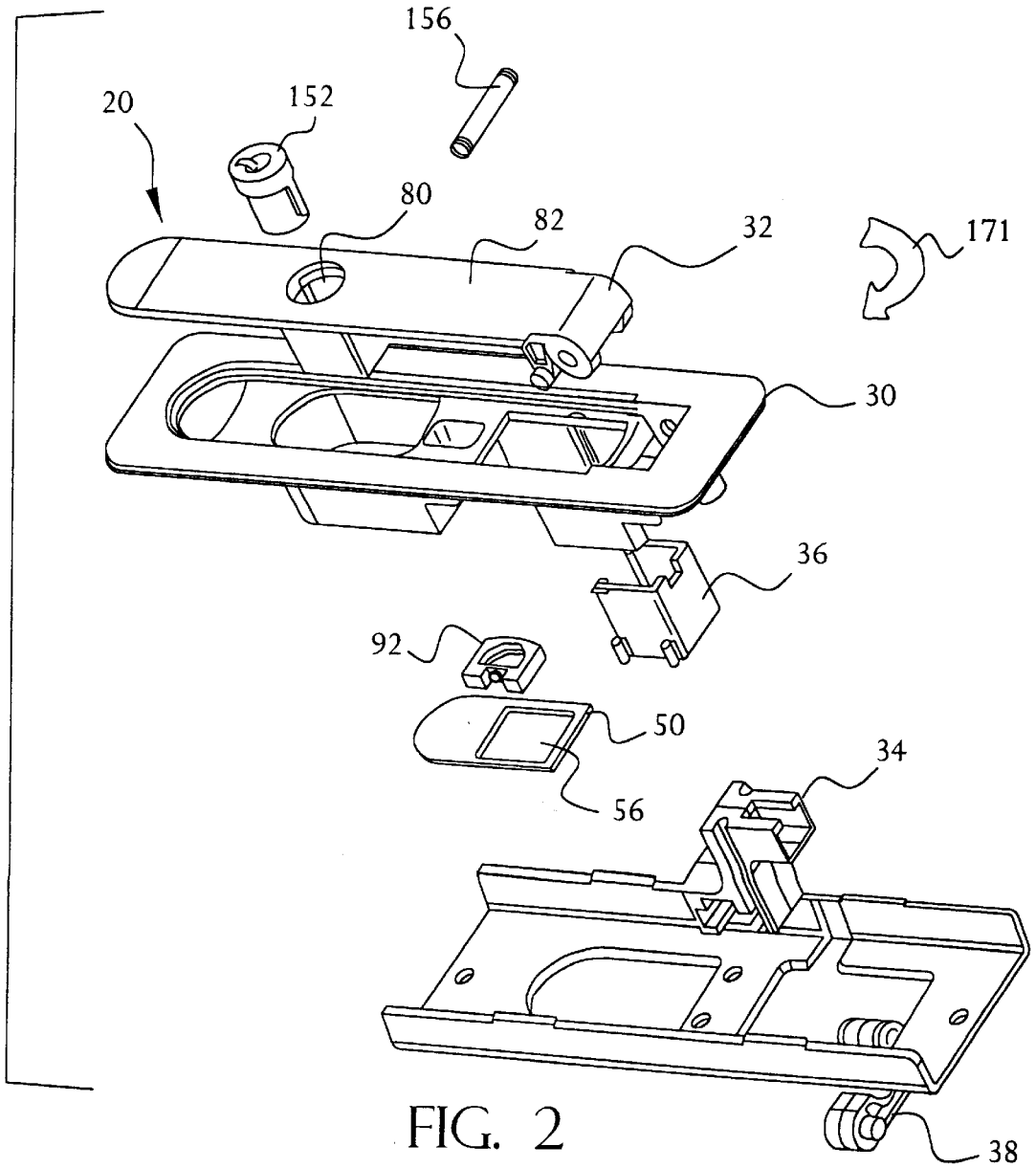
FIG. 2 is an exploded perspective view thereof.
Figure 3:
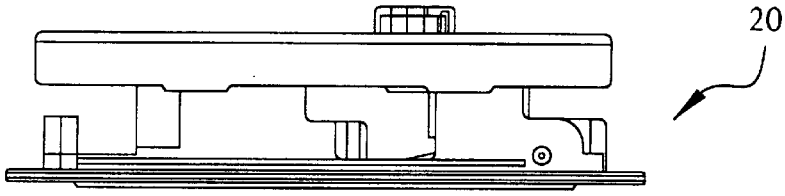
FIG. 3 is a loft side elevational view thereof.
Figure 4:
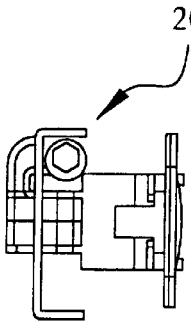
FIG. 4 is a rear elevational view thereof.
Figure 5:
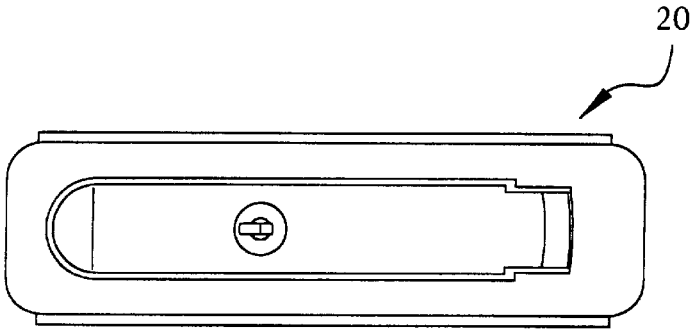
FIG. 5 is a top plan view thereof.
Figure 6:
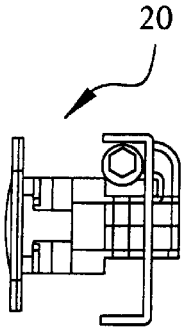
FIG. 6 is a front elevational view thereof.
Figure 7:
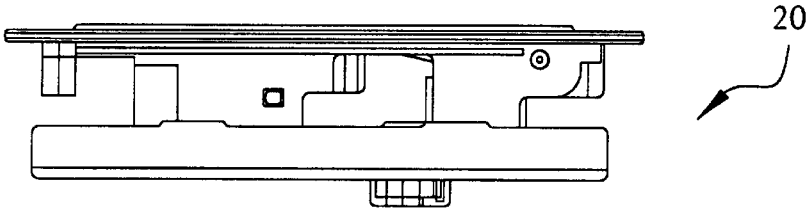
FIG. 7 is a right side elevational view thereof.
Figure 8:
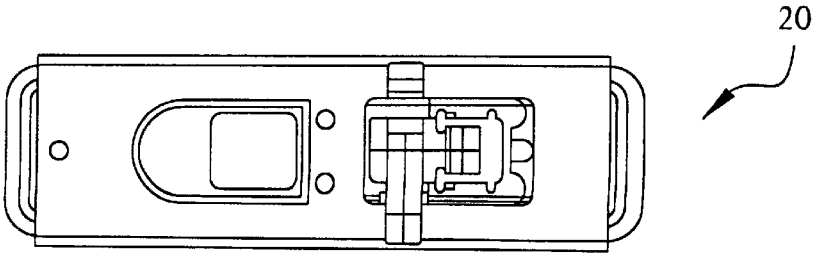
FIG. 8 is a bottom plan view thereof.
Figure 13:
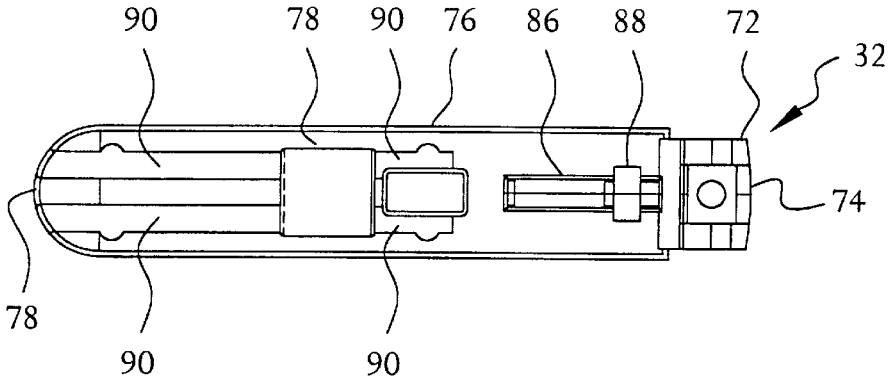
FIG. 13 is a bottom plan view of a handle in accordance with the handle assembly of FIG. 1.
Figure 14:
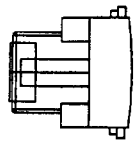
FIG. 14 is a front elevational view of the handle in FIG. 13.
Figure 15:
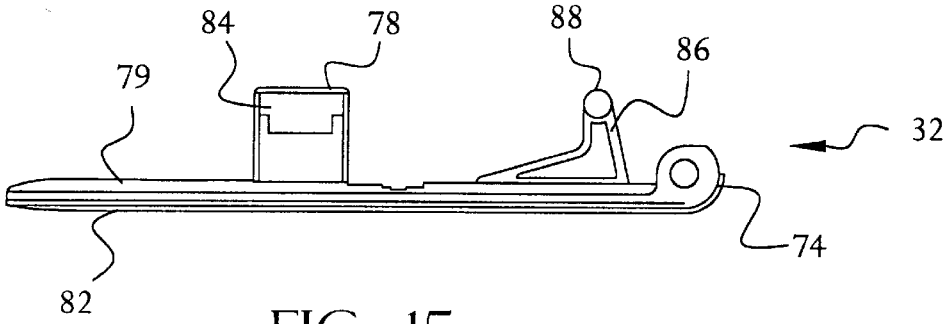
FIG. 15 is a left side elevational view of the handle in FIG. 13, the right side being a mirror image.
Figure 16:
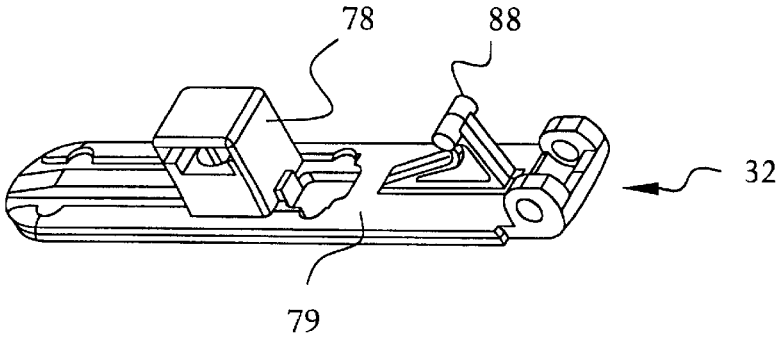
FIG. 16 is a perspective view of the handle in FIG. 13.
Figure 17:
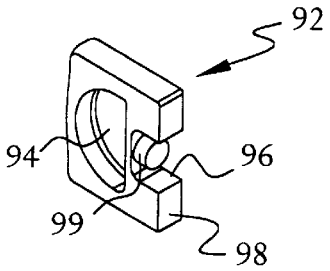
FIGS. 17–26 are views of a pawl lock of the handle assembly of FIG. 1.
Figure 18:
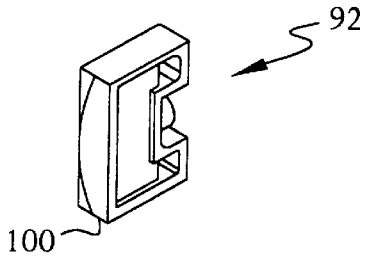
Figure 19:
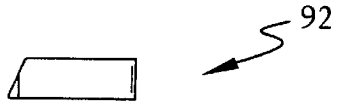
Figure 21:
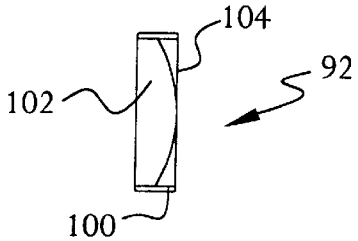
Figure 22:
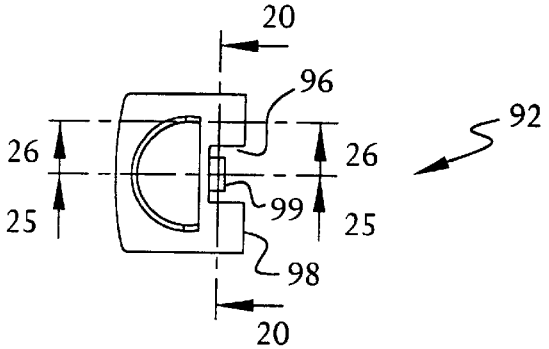
Figure 23:
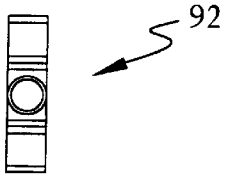
Figure 24:
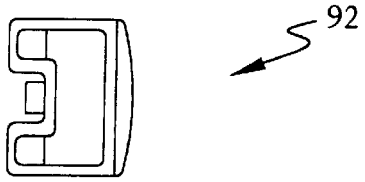
Figure 20:
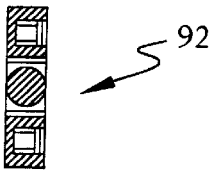
Figure 25:
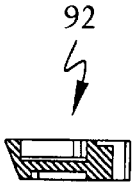
Figure 26:
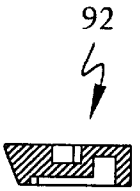
Figure 27:
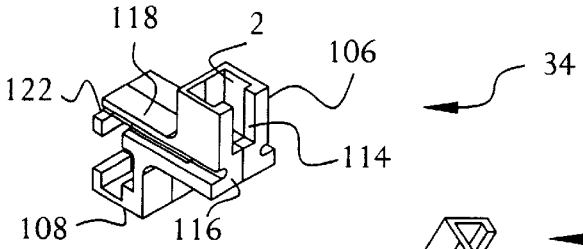
FIGS. 27–35 are views of a slide of a handle assembly of FIG. 1.
Figure 28:
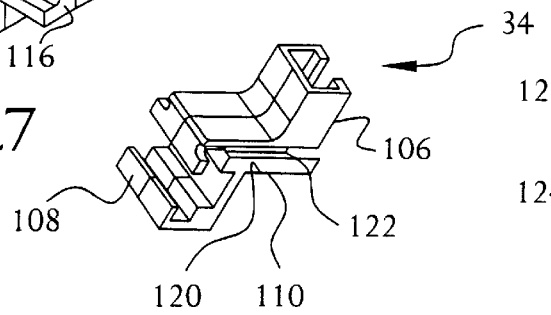
Figure 29:
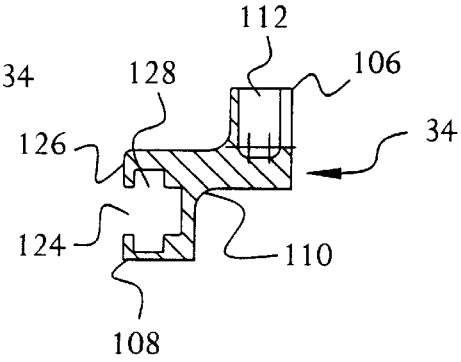
Figure 30:
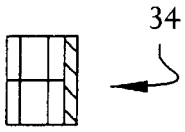
Figure 31:
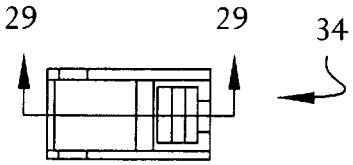
Figure 32:
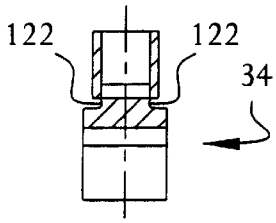
Figure 33:
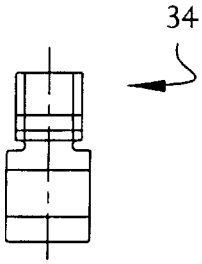
Figure 34:
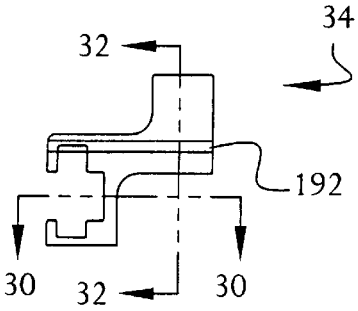
Figure 35:
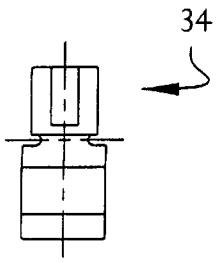
Figure 36:
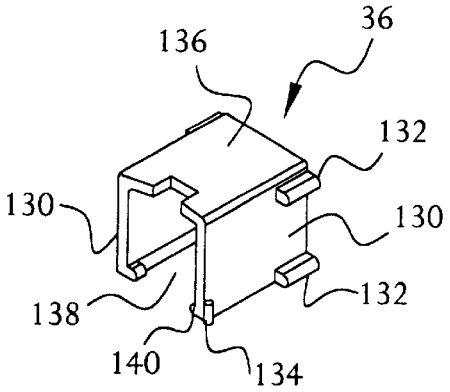
FIGS. 36–42 are views of a cage of a handle assembly of FIG. 1
Figure 37:
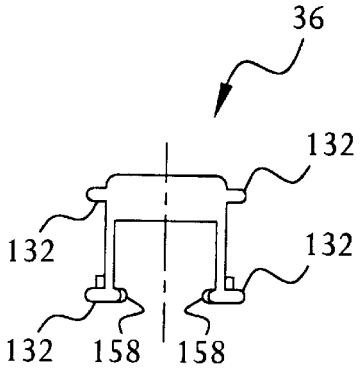
Figure 38:
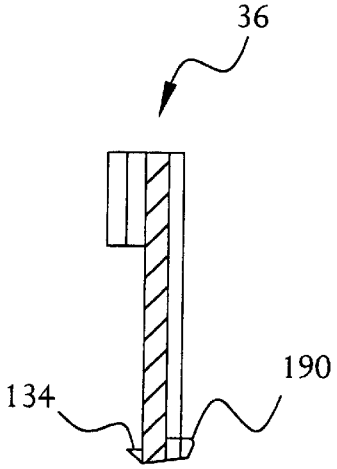
Figure 39:
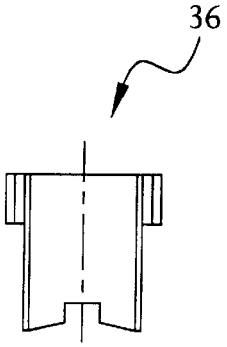
Figure 40:
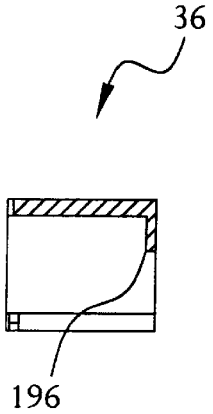
Figure 41:
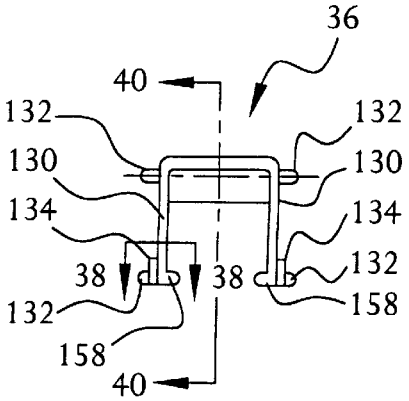
Figure 42:
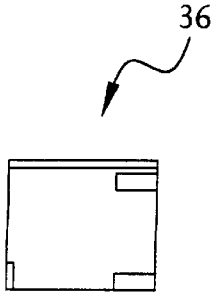
Figure 44:
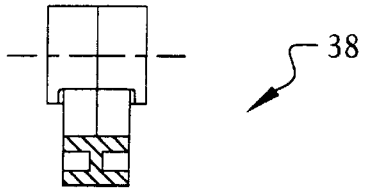
FIGS. 43–47 are views of a crank of a handle assembly of FIG. 1.
Figure 45:
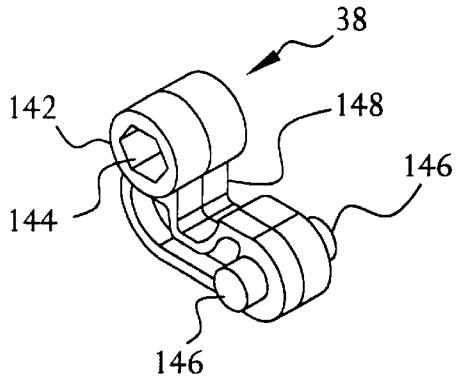
Figure 43:
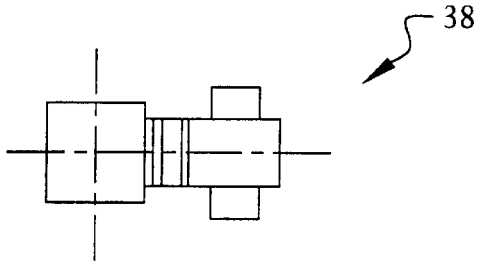
Figure 46:
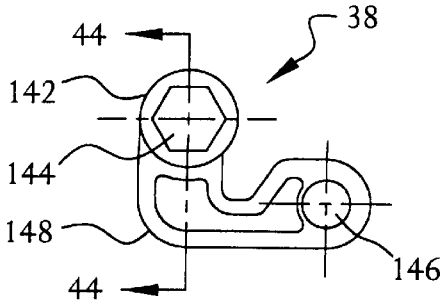
Figure 47:
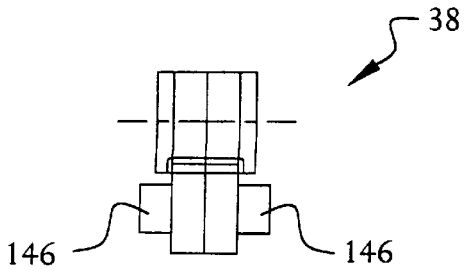
Figure 48:
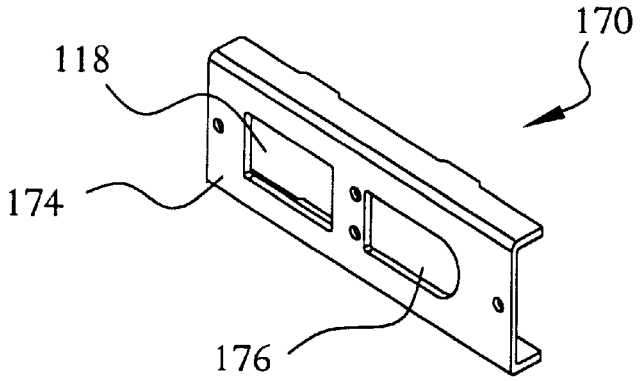
FIGS. 48–51 are views of a bracket of a handle assembly of FIG. 1.
Figure 96:
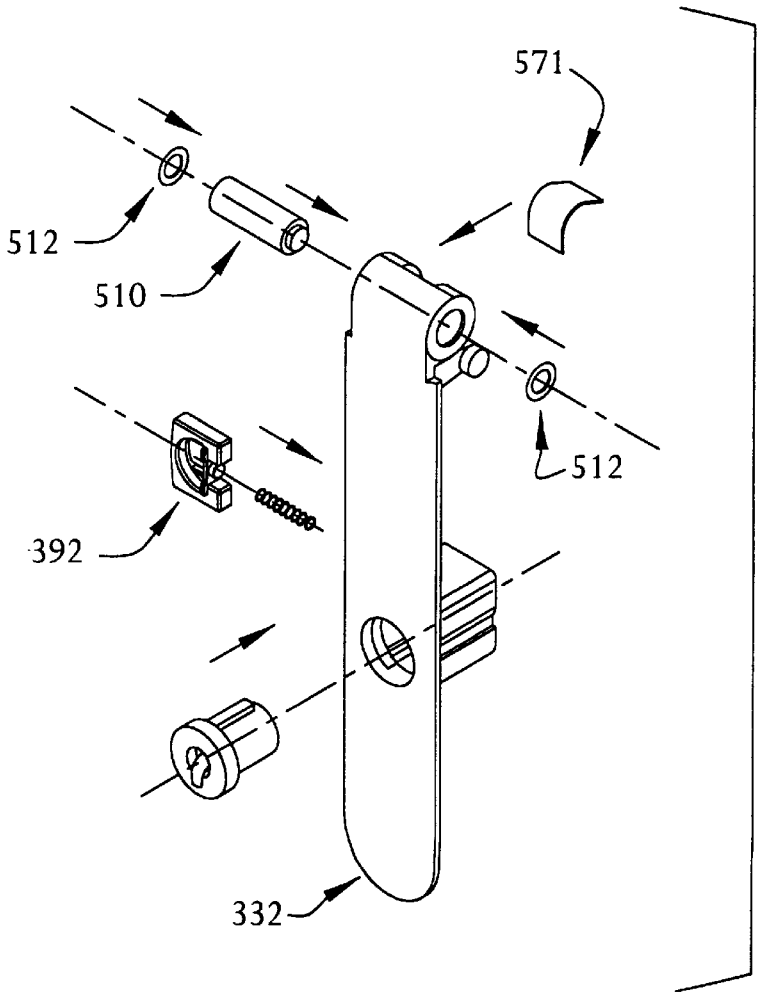
FIGS. 96 and 97 are exploded perspective views illustrating assembly of the components of the handle assembly of FIG. 75.
Figure 97:
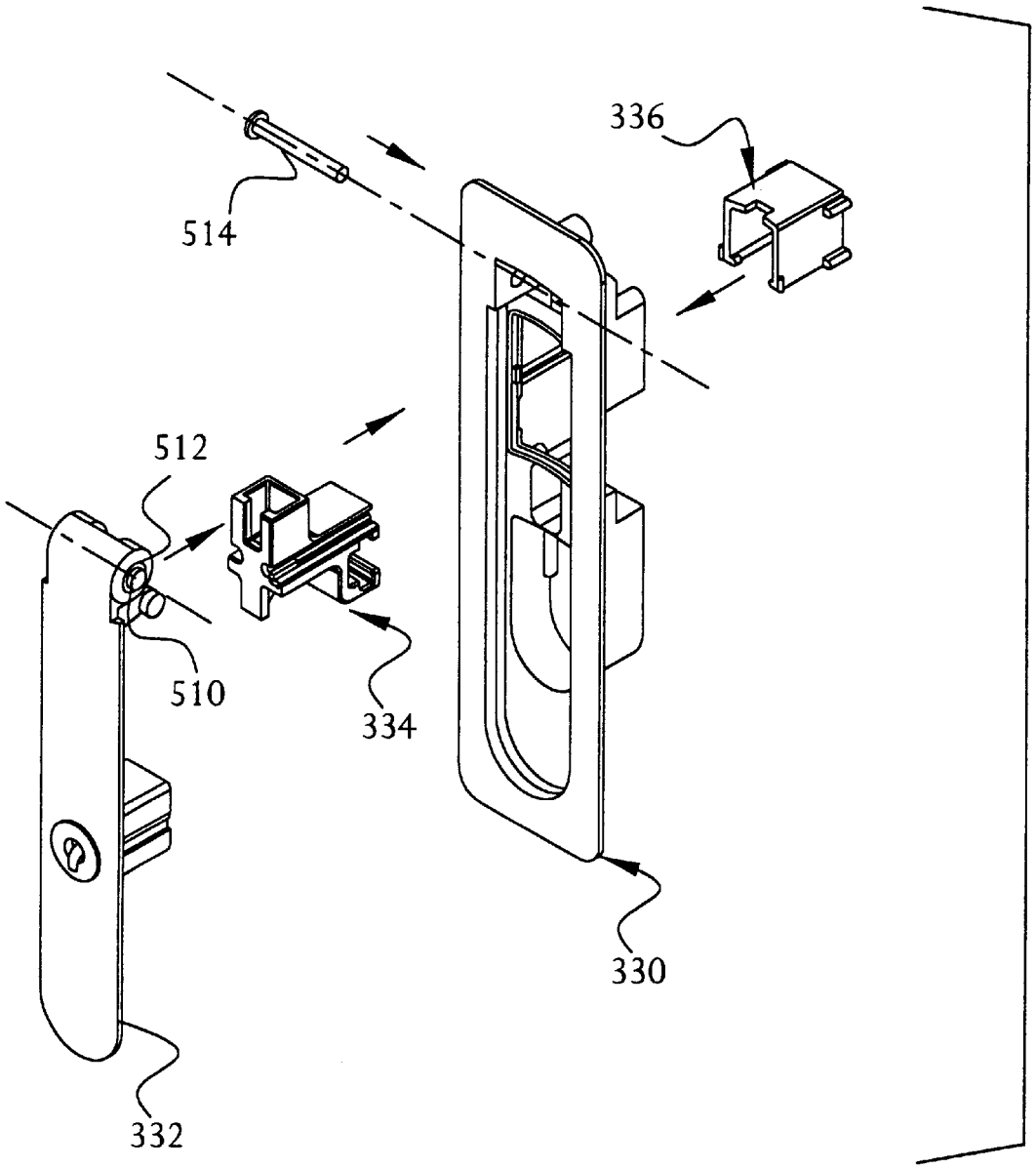

The mechanism for attachment of the handle 332 and housing 330 will now be described. One embodiment is shown in FIGS. 96 and 97. As illustrated, a bushing 510 is provided generally tubular and having bosses at terminating ends and which is inserted into the pair of openings within the pivoting end of the handle 332. A pair of o-rings 512, such as of elastomaic sealing material, for example rubber, is then preferably inserted onto the bosses of bushing 510. A kick-out spring 571, for example similar to the spring 171 in FIG. 2, is inserted in this embodiment around the bushing 510 when positioned in the handle 332. A fastening member 514 is inserted through each of the openings extending through the opposing side walls of the housing 330 and bushing 510 in order to secure the components together; for example, the fastening member 514 in the present embodiment comprises a rivet, such as from metal, and includes a head at one end and is peened over at its terminating end when positioned within the foregoing components.

Figure 98:
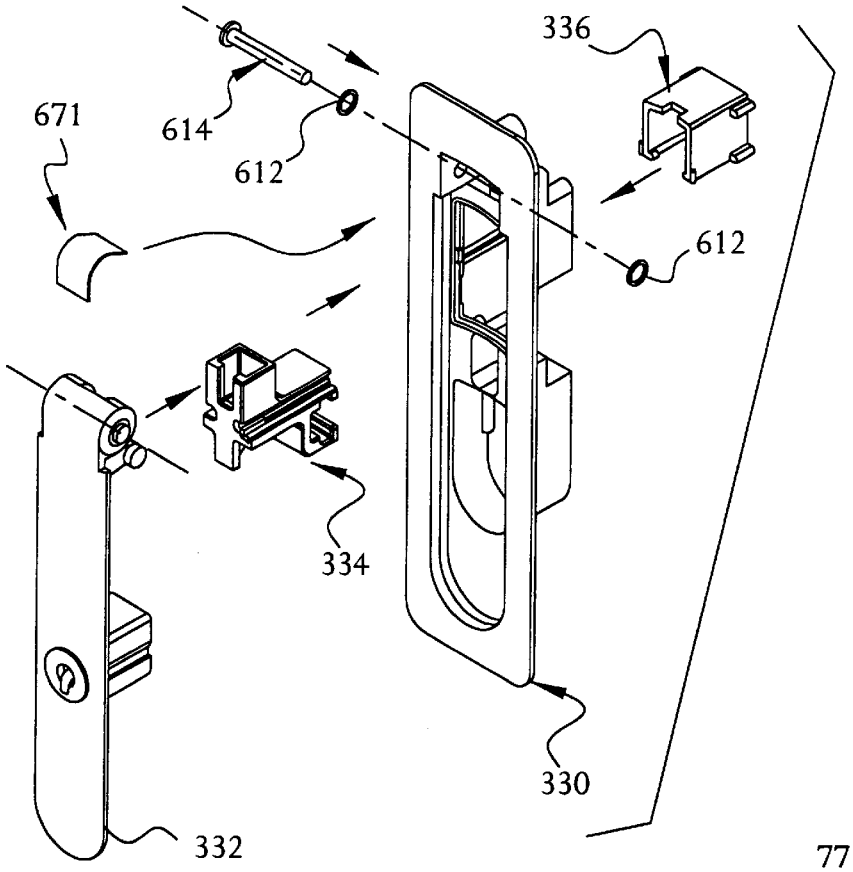
FIG. 98 is an exploded perspective illustrating another embodiment of assembly of the components of the handle assembly of FIG. 75.
Figure 99:
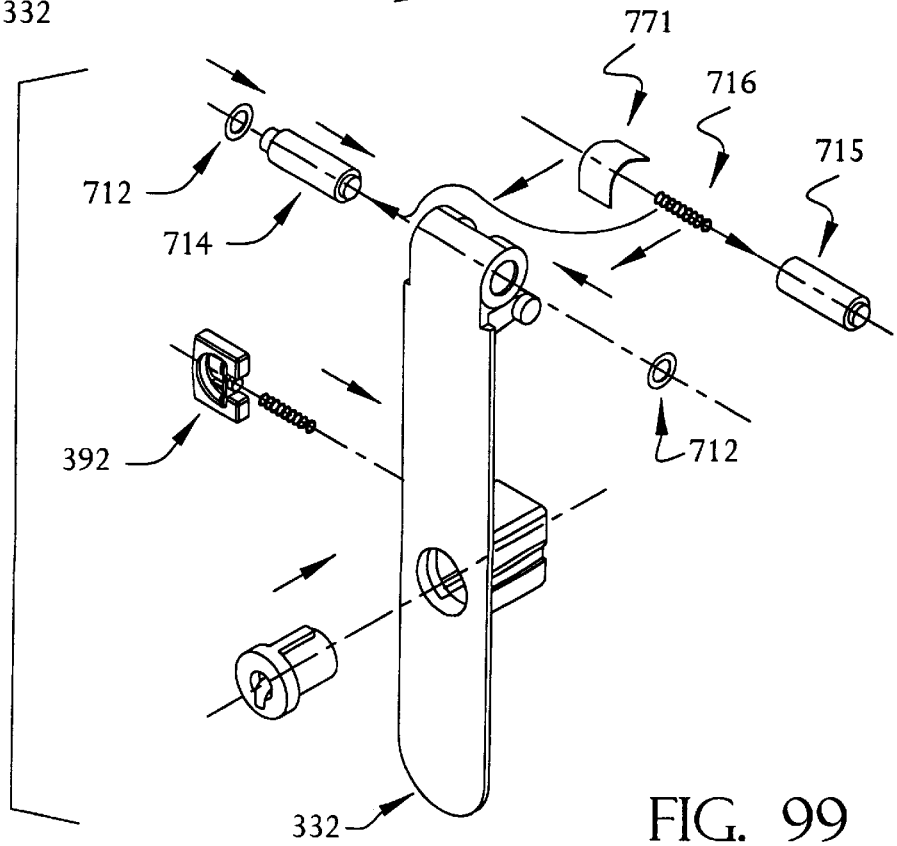
FIGS. 99 and 100 are exploded perspective views illustrating another embodiment of assembly of the components of the handle assembly of FIG. 75.
Figure 100:
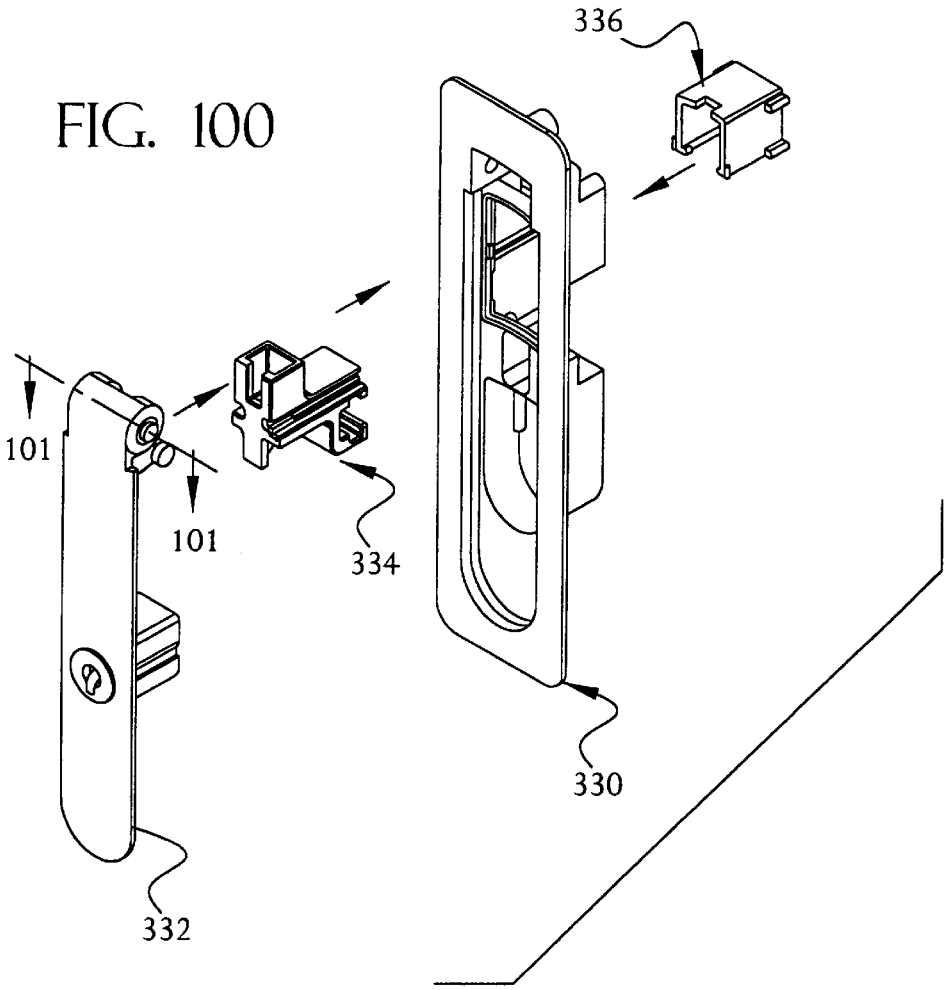

Another embodiment of the mechanism for attaching the handle 332 and housing 330 is shown in FIG. 98. In this embodiment, o-rings 612 are positioned on the rivet 614 at opposite sides of the housing 330. The o-rings 612 are compressed against the outer surfaces of the housing 330 by the head of the rivet on one end and the peening over of the rivet on the opposite end. The kick-out spring 671 prefeIably is also provided and is positioned around the rivet 614 through the handle 332.

Figure 49:
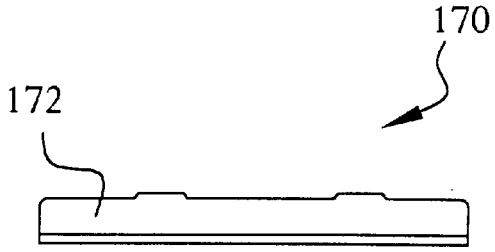
Figure 50:
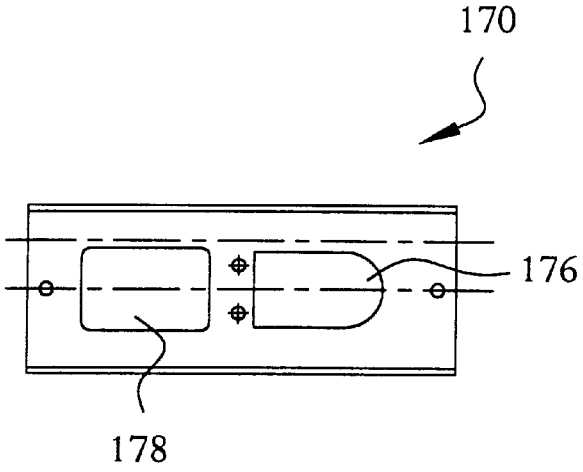
Figure 51:
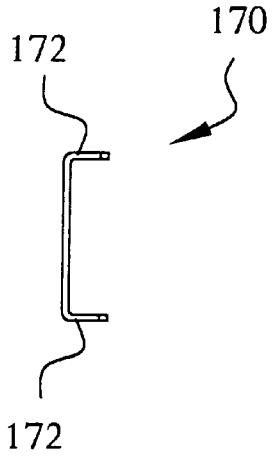
Figure 52:
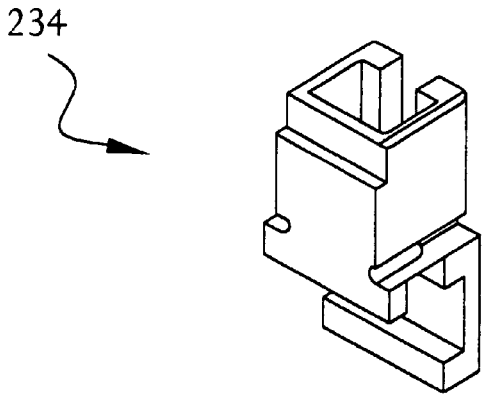
FIGS. 52–55 are views of another embodiment of a slide of FIGS. 27–35.
Figure 53:
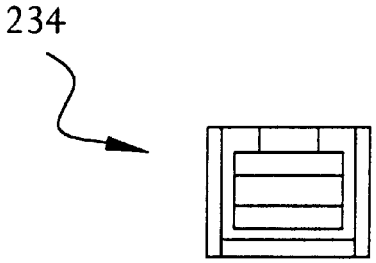
Figure 54:
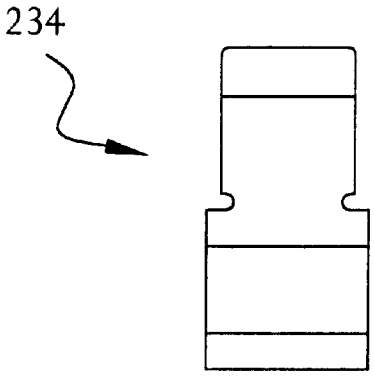
Figure 55:
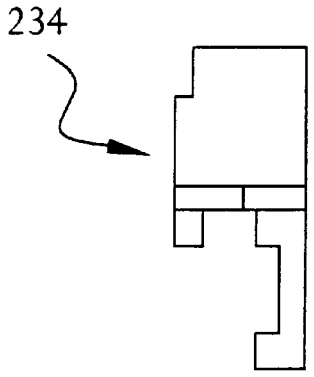
Figure 56:
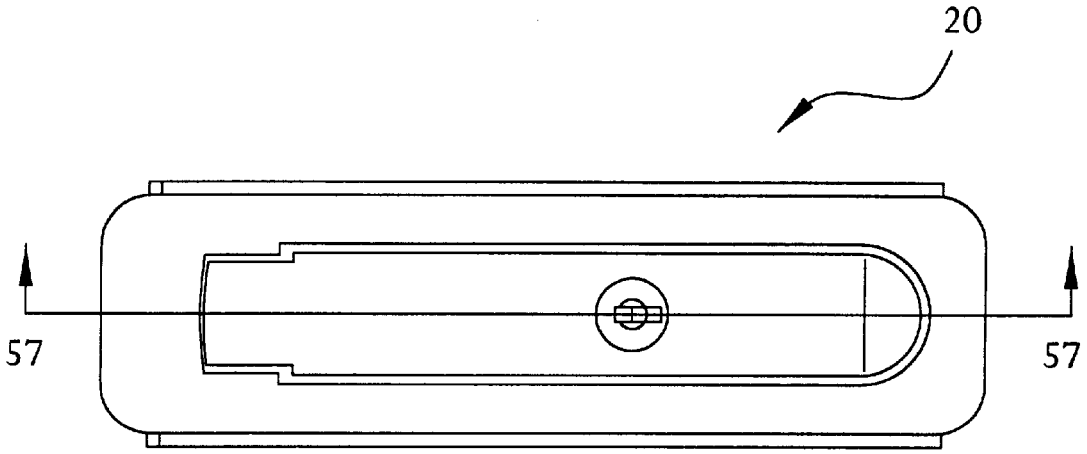
FIGS. 56 and 57 are a top view and a sectional view of the handle assembly of FIG. 1 with the handle in a closed position.
Figure 57:
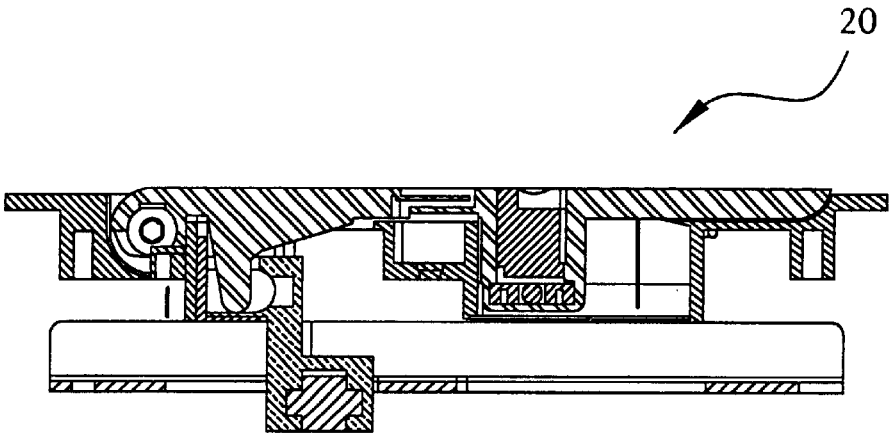
Figure 58:
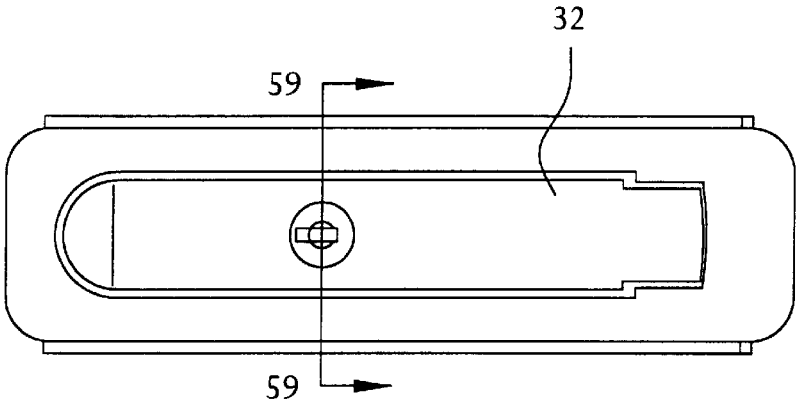
FIGS. 58 and 59 are a top view and a sectional view taken along the line AA of FIG. 58 of the handle assembly of FIG. 1 showing the handle in a closed position.
Figure 101:
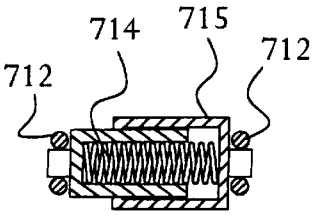
FIG. 101 is a sectional view taken along the line 101—101 of FIG. 100 illustrating the mechanism by which the handle is attached to the housing.

Still another embodiment of the mechanism for attaching the handle 332 to the housing 330 is shown in FIGS. 49–101. In this embodiment, the mechanism is comprised of a two-part pin assembly including inner and outer pins 714 and 715, respectively, and biasing means such as a coil spring 716 between the inner and outer pins 714, 715. As shown in the sectional view of FIG. 101, each of the pins 714 and 715 include a cavity at one end and a boss at opposite ends. In this embodiment, the size of the cavity in the outer pin 715 is of a larger diameter than the cavity in the inner pin 714, which allows the inner pin 715 to be inserted into the cavity in the outer pin 715, and the spring 716 is positioned within both of the cavities between the two pin portions. The o-rings 712 are finally positioned on the bosses of the pins 714 and 715. In operation, the compression of the inner and outer pins 714 and 715 against the force of spring 716 allows the attachment of tne handle 332 and housing 330. The force of the spring 716 forces the inner and outer pins 714, 715 apart to secure the components together. A kick-out spring 771 can also be provided which is mounted on the pin-assembly.

Figure 102:
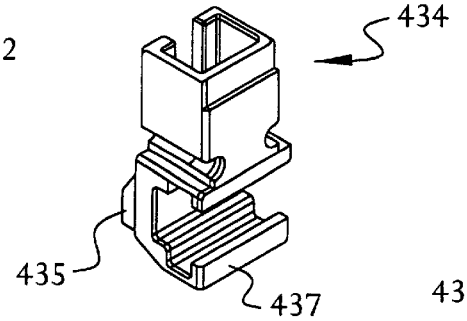
FIGS. 102 and 103 are views of another embodiment of a slide of FIGS. 93–95.
Figure 103:
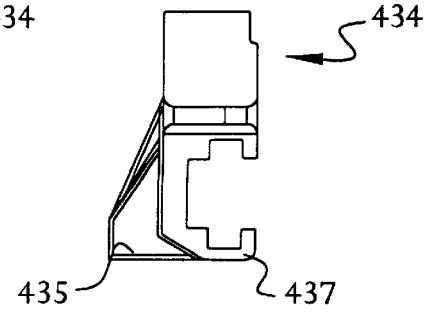

In FIGS. 102 and 103 is illustrated another embodiment of a slide shorter in length to accommodate thinner structures, such as the slide 234. The slide 134 in the present embodiment as compared to the slide 234 includes a nose extension 435 generally triangular in shape and a bottom shelf extension 437 generally L-shaped, which is the area where contact is made by the crank when assembled.

Figure 104:
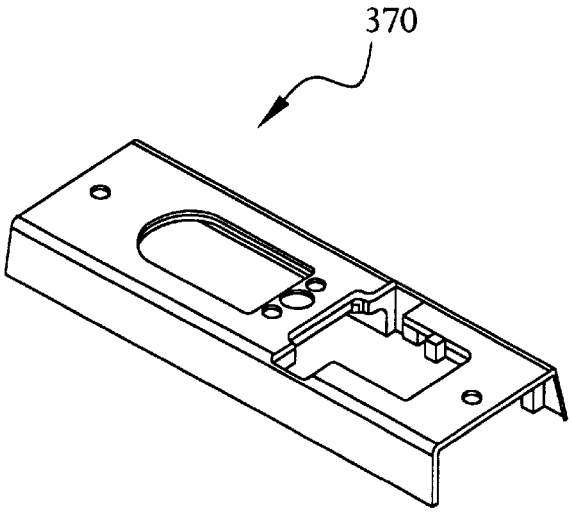
FIGS. 104 and 105 are views of a bracket of the handle assembly of FIG. 75.
Figure 105:
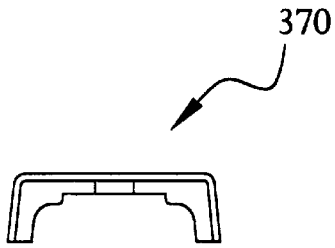

In FIGS. 104 and 105 is shown a mounting bracket 370 of the handle assembly 320. The mounting bracket 370 as compared to the mounting bracket 170 preferably is of a die cast zinc design which allows additional ribbing to increase bending strength.

In view of that set forth above, it should be understood that there are several advantages of the actuator of the present invention alone and as incorporated within a latching mechanism; for example a remote latching mechanism. One advantage in the embodiments disclosed is that the actuator comprising a handle assembly is adapted to be positioned in a vertical orientation when mounted in a panel, which requires less space for mounting in contrast to other types of actuators which are mounted in a horizontal orientation within a panel.

Another particular advantage of the present invention is that the handle assembly in the disclosed embodiments is set flush with the bezel of the supporting housing to reduce pry points, which has the effect to limit its susceptibility to vandalism.

Another advantage of the actuator of the present invention is that it is of sufficient mechanical strength to provide high levels of torque to the connecting means of the remote latching mechanism, which may be required in strenuous applications.

In addition, another advantage of the actuator of the present invention is that it can accommodate a wide variety of panel thicknesses.

Still another advantage in the actuator of the present invention is that a number of different devices can be utilized in order to hold the handle in its closed position; for example, a key-operated lock plug, electronics key, or tool operated slam latch can be incorporated to secure the handle in its closed position. In addition, other non-locking mechanisms can be incorporated to hold the handle in its closed position, such as a rotating or sliding pawl operated by rotatable or push button actuating members as an example. Furthermore, additional security devices can also be included, such as a conventional pad lock device.

Still other advantages of the actuator of the present invention is that it can be shielded against various forms of matter, such as high pressured jets of water and wind driven rain, as well as EMC to telecommunications specifications. For example, gasketing material can be included on the bottom side of the flange or within a groove in the bottom side of the flange. Also, gasketing material can be included between the handle and the housing, for example, to seal the rectangular opening 58 by a gasket seal of proper thickness, applied either on the underside of the handle or on the housing surrounding the perimeter of the opening.

Another advantage of the actuator of the present invention is that it can easily accommodate left hand or right hand doors or other panels.

Another particular advantage of the present invention is that the handle assembly can be utilized with remote latching mechanisms in which multiple latching points are desired, for example three latching members, which is due primarily to the feature that a single connecting bar or rod can be utilized.

Another advantage or the actuator of the present invention is that there is limited protrusion outside the application (flange thickness) and limited protrusion inside the application due to telescoping of cage and slide.

It will be recognized by those skilled in the art that changes may be made by the above-described embodiments of the invention without departing from the broad inventive concepts thereof. It is understood, therefore, that this invention is not limited to the particular embodiments disclosed, but it is intended to cover all modifications which are within the scope and spirit of the invention as defined by the appended clams.

We claim:

1. A remote latching mechanism comprising:

a longitudinal connecting member rotatably movable about a longitudinal axis thereof;

at least one latch assembly operably connected to said connecting member for movement between latched and unlatched conditions in response to rotational movement of said connecting member; and actuator means for rotating said connecting member, said actuator means comprising a handle pivotally movable in substantially a perpendicular direction to the axis of rotation of said longitudinal axis of said connecting member between open and closed positions for rotatably moving said connecting member, wherein contact of said handle and a remainder of said actuator assembly occurs only during actuation.

2. A remote latching mechanism of claim 1, wherein said actuator means further comprises a slide assembly, wherein each component of said slide assembly is movable, said slide assembly located between said handle and said connecting member for rotatably moving said connecting member upon pivotal movements of said slide assembly and said handle between said open and closed positions.

3. A remote latching mechanism of claim 2, wherein said slide assembly comprises a slide and a crank, said slide engaging said handle for substantially axial movement between inward and outward positions upon said pivotal movements of said handle between said closed and open positions, respectively, said crank engaging said slide proximate a first end of said crank and said connecting member proximate a second end for rotatably moving said connecting member upon said substantially axial movements of said slide.

4. A remote latching mechanism of claim 3, wherein said slide assembly further comprises a cage engaging said slide for regulating pivotal movement of said handle in said open position.

5. A remote latching mechanism of claim 4, wherein said actuator means further comprises a housing to which said handle is pivotally connected.

6. A remote latching mechanism of claim 5 further comprising means between said handle and said housing for retaining said handle in said closed position thereof.

7. A remote latching mechanism comprising:

a longitudinal connecting member rotatably movable about a longitudinal axis thereof;

at least one latch assembly operably connected to said connecting member for movement between latched and unlatched conditions in response to rotational movement of said connecting member; and actuator means for rotating said connecting member, said actuator means comprising a handle pivotally movable in substantially along said longitudinal axis of said connecting member between open and closed positions for rotatably moving said connecting member, wherein said actuator means further comprises a slide assembly between said handle and said connecting member for rotatably moving said connecting member upon pivotal movements of said handle between said open and closed positions, wherein said slide assembly comprises a slide and a crank, said slide engaging said handle for substantially axial movement between inward and outward positions upon said pivotal movements of said handle between said closed and open positions, respectively, said crank engaging said slide proximate a first end of said crank and said connecting member proximate a second end for rotatably moving said connecting member upon said substantially axial movements of said slide, wherein said slide assembly further comprises a cage engaging said slide for regulating pivotal movement of said handle in said open position, wherein said actuator means further comprises a housing to which said handle is pivotally connected, wherein said remote latching mechanism further comprises a means between said handle and said housing for retaining said handle in said closed position thereof, wherein said remote latching mechanism further comprises a means for disengaging said retaining means and means for biasing said handle from said closed position toward said open position.

8. A remote latching mechanism of claim 7, wherein said second end of said crank is fixed to said connecting member.

9. A remote latching mechanism of claim 8, wherein said second end of said crank includes a non-circular aperture therein and a portion of said connecting member extends through, and in cross-section corresponds in configuration to, said non-circular aperture.

10. A remote latching mechanism of claim 8, wherein said crank proximate a first end thereof includes a pair or substantially opposing bosses said bosses proximate a first end of said slide said first end of said slide includes a pair of substantially opposing walls each having a channel for receiving said bosses of said crank for providing said engagement of said crank and said slide.

11. A remote latching mechanism of claim 10, wherein said handle. comprises a bottom surface and a projection extending from said bottom surface, said projection having a pair of bosses proximate a terminating end, said slide having a cavity therein proximate a second end receiving said bosses of said handle for engagement of said handle and said slide.

12. A remote latching mechanism of claim 11, wherein said cage comprises an opening therethrough and said slide is received in said opening through said slide.

13. A remote latching mechanism of claim 12, wherein said cage includes a pair of opposing bosses on inner surfaces thereof and said slide includes a pair of substantially opposing channels extending in a longitudinal direction and receiving said bosses of said cage.

14. A remote latching mechanism of claim 13 further comprising means between said cage and said slide for limiting relative movement.

15. A remote latching mechanism of claim 13, therein said housing includes a cavity therethrough receiving said slide and said cage, wherein said remote latching mechanism further comprises means between said cage and said housing for limiting substantially axial movements of said cage within said housing aperture.

16. A remote latching mechanism of claim 15 further comprising means between said cage and said housing for limiting substantially axial movements of said cage in said housing aperture.

17. A remote latching mechanism of claim 16, wherein said means between said handle and said housing for retaining said handle in said closed position thereof and said means for disengaging said retaining means comprises a disengagement member end a lock pawl mounted on said handle and a keeper on said housing, wherein said lock pawl engages said keeper for retaining said handle in said closed position and actuation of said disengagement member moves said lock pawl to a retracted position out of contact from said keeper and said handle is moved by said biasing means toward said open position.

18. A remote latching mechanism of claim 17, wherein said disengagement member comprises a rotatable lock plug.

19. A remote latching mechanism of claim 18, wherein said lock pawl includes a wall engaged by an extension of said lock plug on rotation of said lock plug for moving said lock pawl to its retracted position.

20. A remote latching mechanism of claim 17 further comprising a spring for biasing said lock pawl to said extended position.

21. A remote latching mechanism of claim 20, wherein said means for biasing said handle toward said open position comprises a spring.

22. A remote latching mechanism of claim 21, wherein said spring is a leaf spring.

23. A remote latching mechanism of claim 22, wherein said handle is pivotally connected to said housing by a pivot pin.

24. A remote latching mechanism of claim 23, wherein said pivot. pin comprises an assembly including first and second portions and a spring between said first and second portions.

25. A remote latching mechanism of claim 24 further comprising a mounting bracket.

26. A latching mechanism comprising:

a latch assembly for movement between latched and unlatched conditions, said latch assembly including at least one longitudinal connecting member; and actuator means for operating said latch assembly, said actuator means comprising a handle assembly, with said handle assembly having a handle pivotally movable in substantially a perpendicular direction to the axis of rotation of said longitudinal axis of said connecting member and a slide assembly between said handle and said latch assembly for operating said latch assembly upon pivotal movements of said handle between open and closed positions, wherein said slide assembly comprises a movable slide and a movable crank, said slide engaging said handle for substantially axial movement between said closed and open outward positions upon said pivotal movements of said handle between said closed and open positions, respectively, said crank engaging said slide proximate a first end of said crank and said at least one connecting member proximate a second end for moving said connecting member upon said substantially axial movements of said slide.

27. A latching mechanism of claim 26, wherein said slide assembly further comprises a cage engaging said slide for regulating pivotal movement of said handle in said open position.

28. A latching mechanism of claim 27, wherein said handle assembly further comprises a housing to which said handle is pivotally connected.

29. A latching mechanism of claim 28 further comprising means between said handle and said housing for retaining said handle in said closed position thereof.

30. A latching mechanism comprising:

a latch assembly for movement between latched and unlatched conditions, said latch assembly including at least one longitudinal connecting member and means for latching on said connecting member; and actuator means for operating said latch assembly, said actuator means comprising a handle assembly, with said handle assembly having a handle and a slide assembly between said handle and said latch assembly for opening said latch assembly upon pivotal movements of said handle between open and closed positions, wherein said slide assembly comprises a slide and a crank, said slide engaging said handle for substantially axial movement between inward and outward positions upon said pivotal movements of said handle between said closed and open positions, respectively, said crank engaging said slide proximate a first end of said crank and said at least one connecting member proximate a second end for moving said connecting member upon said substantially axial movements of said slide, wherein said slide assembly further comprises a cage engaging said slide for regulating pivotal movement of said handle in said open position, wherein said handle assembly further comprises a housing to which said handle is pivoting connected, wherein said latching mechanism further comprises a means between said handle and said housing for retaining said handle in said closed position thereof, wherein said latching mechanisms further comprises a means for disengaging said retaining means and means for biasing said handle from said closed position toward said open position.

31. A latching mechanism of claim 30, wherein said second end of said crank is fixed to said at least one connecting member.

32. A latching mechanism of claim 31, wherein said second end of said clank includes a non-circular aperture therein and a portion of said at least one connecting member extends through, and in cross-section corresponds in configuration to, said non-circular aperture.

33. A latching mechanism of claim 32, wherein said crank proximate a first end thereof includes a pair of substantially opposing bosses said bosses proximate a first end of said slide includes a pair of substantially opposing walls each having a channel for receiving said bosses of said crank for providing said engagement of said crank and said slide.

34. A latching mechanism of claim 33, wherein said handle comprises a bottom surface and projection extending from said bottom surface, said projection having a pair of bosses proximate a terminating end, said slide having a cavity therein proximate a second end receiving said bosses of said handle for engagement of said handle and said slide.

35. A latching mechanism of claim 34, wherein said cage comprises an opening therethrough and said slide is received in said opening through said slide.

36. A latching mechanism of claim 35, wherein said cage includes a pair of opposing bosses on inner surfaces thereof and said slide includes a pair of substantially opposing channels extending in a longitudinal direction and receiving said bosses of said cage.

37. A latching mechanism of claim 36 further comprising means between said cage and said slide for limiting relative movement.

38. A latching mechanism of claim 37, wherein said housing includes a cavity therethrough receiving said slide and said cage, wherein said latching mechanism further comprises means between said cage and said housing for limiting substantially axial movements of said cage within said housing aperture.

39. A latching mechanism of claim 38 further comprising means between said cage and said housing for limiting substantially axial movements of said cage in said housing aperture.

40. A latching mechanism of claim 39, wherein said means between said handle and said housing for retaining said handle in said closed position thereof and said means for disengaging said retaining means comprises a rotatable disengagement member and a lock pawl mounted of said handle and a keeper on said housing, wherein said lock pawl engages said keeper for retaining said handle in said closed position and rotation of said disengagement member moves said lock pawl to a retracted position out of contact from said keeper and said handle is moved by said biasing means toward said open position.

41. A latching mechanism of claim 39, wherein the disengagement member comprises a lock plug and said lock pawl includes a wall engaged by an extension of said lock plug on rotation of said lock plug for moving said lock pawl to said retracted position.

42. A latching mechanism of claim 40 further comprising a spring for biasing said lock pawl to said extended position.

43. A latching mechanism of claim 41, wherein said means for biasing said handle toward said open position comprises a spring.

44. A latching mechanism of claim 42, wherein said spring is a leaf spring.

45. A latching mechanism of claim 43, wherein said handle is pivotally connected to said housing by a pivot pin.

46. A latching mechanism of claim 44, wherein said pivot pin comprises an assembly including first and second portions and a spring between said first and second portions.

47. A latching mechanism of claim 46 further comprising a mounting bracket.

* * * * *